US009589774B2

(12) United States Patent
Shimoi et al.

(10) Patent No.: US 9,589,774 B2
(45) **Date of Patent: *Mar. 7, 2017**

(54) ELECTRON MULTIPLIER AND PHOTOMULTIPLIER INCLUDING THE SAME

(71) Applicant: HAMAMATSU PHOTONICS K.K., Hamamatsu-shi, Shizuoka (JP)

(72) Inventors: Hideki Shimoi, Hamamatsu (JP); Hiroyuki Kyushima, Hamamatsu (JP); Keisuke Inoue, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/043,263

(22) Filed: Feb. 12, 2016

(65) Prior Publication Data

US 2016/0172169 A1 Jun. 16, 2016

Related U.S. Application Data

(63) Continuation of application No. 13/484,663, filed on May 31, 2012, now Pat. No. 9,293,309.

(60) Provisional application No. 61/492,857, filed on Jun. 3, 2011.

(51) Int. Cl.
*H01J 43/22* (2006.01)

(52) U.S. Cl.
CPC ..... *H01J 43/22* (2013.01)

(58) Field of Classification Search
CPC ..... H01J 43/18; H01J 43/22
USPC ..... 313/533, 534, 532, 535, 336, 542, 544, 313/103 R, 103 CM, 104, 105 R, 308
See application file for complete search history.

(56) References Cited

U.S. PATENT DOCUMENTS

| | | | | |
|---|---|---|---|---|
| 4,147,929 | A | 4/1979 | Taylor | |
| 4,149,106 | A | 4/1979 | de Wolf et al. | |
| 4,422,005 | A | 12/1983 | Washington et al. | |
| 4,482,836 | A | 11/1984 | Washington et al. | |
| 4,626,736 | A | 12/1986 | Mansell | |
| 5,264,693 | A | 11/1993 | Shimabukuro et al. | |
| 5,329,110 | A | 7/1994 | Shimabukuro et al. | |
| 5,568,013 | A | 10/1996 | Then et al. | |
| 5,744,908 | A | 4/1998 | Kyushima | |
| 5,880,458 | A * | 3/1999 | Shimoi | H01J 43/22 250/207 |

(Continued)

FOREIGN PATENT DOCUMENTS

| | | | |
|---|---|---|---|
| CN | 1717770 | A | 1/2006 |
| CN | 101189700 | A | 5/2008 |

(Continued)

*Primary Examiner* — Karabi Guharay
*Assistant Examiner* — Fatima Farokhrooz
(74) *Attorney, Agent, or Firm* — Drinker Biddle & Reath LLP

(57) ABSTRACT

The present invention relates to an electron multiplier and others to effectively suppress luminescence noise, even in compact size, in which each of multistage dynodes has a plurality of columns each having a peripheral surface separated physically, and in which each column is processed in such a shape that an area or a peripheral length of a section parallel to an installation surface on which the electron multiplier is arranged becomes minimum at a certain position on the peripheral surface in the column of interest.

21 Claims, 21 Drawing Sheets

(56) References Cited

U.S. PATENT DOCUMENTS

| | | | |
|---|---|---|---|
| 7,049,747 | B1 | 5/2006 | Goodberlet et al. |
| 7,294,954 | B2 | 11/2007 | Syms |
| 7,880,385 | B2 | 2/2011 | Kyushima et al. |
| 8,115,386 | B2 | 2/2012 | Shimoi et al. |
| 8,188,656 | B2 | 5/2012 | Sugiyama et al. |
| 2003/0137244 | A1 | 7/2003 | Shimoi et al. |
| 2008/0088234 | A1 | 4/2008 | Ohmura et al. |
| 2009/0224666 | A1 | 9/2009 | Kyushima et al. |
| 2010/0213838 | A1 | 8/2010 | Sugiyama et al. |
| 2012/0091316 | A1 | 4/2012 | Shimoi et al. |
| 2012/0091889 | A1 | 4/2012 | Shimoi et al. |
| 2012/0091890 | A1 | 4/2012 | Shimoi et al. |

FOREIGN PATENT DOCUMENTS

| | | | |
|---|---|---|---|
| CN | 101189701 | A | 5/2008 |
| EP | 0 349 081 | A | 1/1990 |
| EP | 1 921 660 | A1 | 5/2008 |
| JP | S49-131569 | A | 12/1974 |
| JP | S57-46458 | A | 3/1982 |
| JP | 60-182642 | | 9/1985 |
| JP | 10-116582 | | 5/1998 |
| JP | 11-3677 | | 1/1999 |
| JP | 2010-262811 | A | 11/2010 |
| JP | 2010-262812 | A | 11/2010 |
| JP | 2010-267414 | A | 11/2010 |
| WO | WO-2007/020741 | A1 | 2/2007 |

* cited by examiner

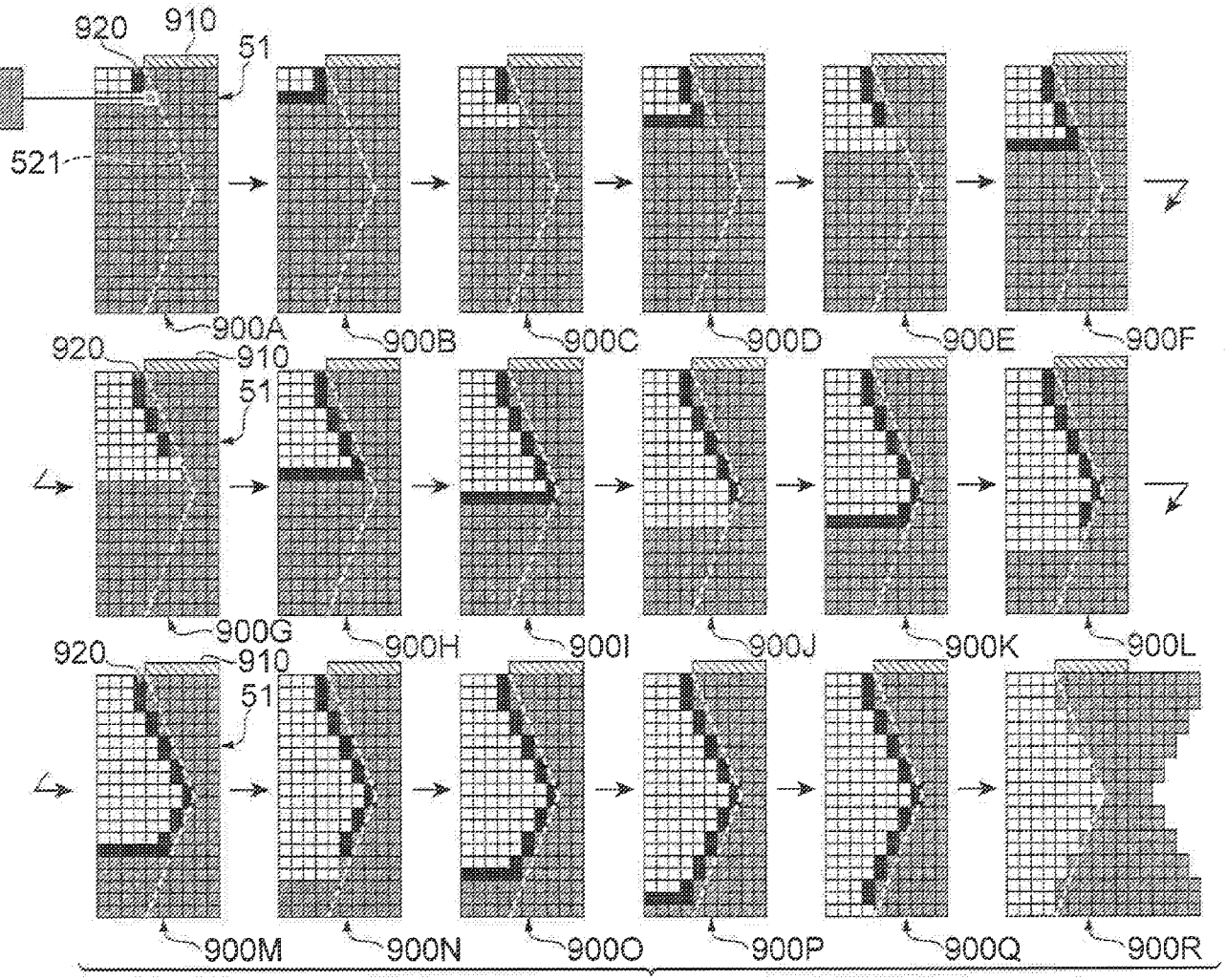
Fig.9B
Fig.9C
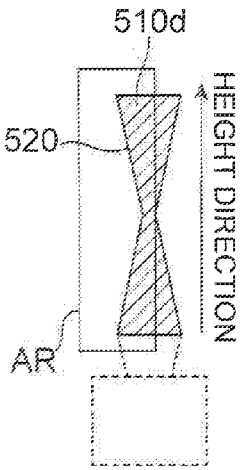
Fig.9A

ELECTRON MULTIPLIER AND PHOTOMULTIPLIER INCLUDING THE SAME

CROSS-REFERENCE TO RELATED APPLICATION

This is a continuation application of application Ser. No. 13/484,663 filed on May 31, 2012, which claims the benefit of U.S. Provisional Application No. 61/492,857 filed on Jun. 3, 2011; the entire contents of each of these are incorporated by reference herein in their entirety.

BACKGROUND OF THE INVENTION

Field of the Invention

The present invention relates to a photomultiplier to detect incident light from the outside and an electron multiplier applicable to a wide variety of sensor devices including the photomultiplier.

Related Background Art

Compact photomultipliers have been developed heretofore using the microfabrication technology. For example, there is a known planar photomultiplier in which a photocathode, dynodes, and an anode are arranged on an optically-transparent insulating substrate (cf. U.S. Pat. No. 5,264,693). This structure realizes detection of weak light and achieves miniaturization of the device as well.

SUMMARY OF THE INVENTION

The Inventor investigated the aforementioned conventional photomultiplier and found the problem as described below.

Namely, in the conventional photomultiplier, the structural elements at different potentials are arranged next to each other on the insulating substrate. For this reason, when the photomultiplier is constructed in compact size, generated secondary electrons impinge on the insulating substrate to cause unwanted luminescence, which becomes a noise source.

The present invention has been accomplished in view of the above-described problem and an object of the present invention is to provide an electron multiplier with a dynode structure for effectively suppressing the luminescence noise, even in compact size, and a photomultiplier including the same.

An electron multiplier according to the present invention comprises multistage dynodes which are arranged in series along a first direction on a predetermined installation surface, and on the installation surface and which implement cascade multiplication of electrons traveling along a direction parallel to the first direction. Each of the multistage dynodes comprises: a common pedestal extending along a second direction perpendicular to the first direction on the installation surface; and a plurality of columns installed on the pedestal in a state in which the columns are spaced apart by a predetermined distance, thereby to be electrically connected through the pedestal. Each column extends along a third direction perpendicular to the installation surface and has a sidewall shape defined by a peripheral surface separated physically.

A first aspect of the electron multiplier having the structure as described above preferably has the following configuration: in each of the multistage dynodes, at least any one column out of the plurality of columns has a shape processed so that an area or a peripheral length of a section perpendicular to the third direction becomes minimum at a certain position on the peripheral surface in the column of interest.

A second aspect of the electron multiplier having the structure as described above preferably has the following configuration: in each of the multistage dynodes, a surface shape of a region where a single secondary electron emitting surface is formed in the peripheral surface of at least any one column out of the plurality of columns has a section defined by a plane including both of the first and third directions, the section being defined by line segments including one or more depressed shapes entering into the column of interest.

Furthermore, a third aspect of the electron multiplier having the structure as described above preferably has the following configuration: in each of the multistage dynodes, at least any one column out of the plurality of columns has a section defined by a plane including both of the first and third directions, the section having a sectional shape processed so that a width of the column of interest defined by a length along the first direction becomes minimum at a certain position on the peripheral surface in the column of interest.

It is noted that each of the above first to third aspects can be carried out singly or that two or more of the first to third aspects can be carried out in combination. These first to third aspects, when applied singly or in combination, can realize the dynodes, particularly, their columns in which the region where the secondary electron emitting surface is formed has a constricted structure.

A fourth aspect to which at least one of the first to third aspects is applicable preferably has the following configuration: in each of the multistage dynodes, a surface shape of a region where a single secondary electron emitting surface is formed in the peripheral surface of at least any one column out of the plurality of columns is composed of one or more curved surfaces, one or more planes, or a combination thereof.

Furthermore, as a fifth aspect, a photomultiplier according to the present invention comprises an envelope, a photocathode, an electron multiplier, and an anode. The envelope is one an interior of which is maintained in a reduced pressure state, and at least a part of which is comprised of a substrate of an insulating material having an installation surface. The photocathode is one which is housed in an interior space of the envelope and which emits photoelectrons into the interior of the envelope according to light incident through the envelope. The electron multiplier is arranged on the installation surface in a state in which the electron multiplier is housed in the interior space of the envelope. The electron multiplier according to at least any one of the above first to fourth aspects can be applied to the electron multiplier of the photomultiplier according to the fifth aspect. The anode is an electrode which is arranged on the installation surface in a state in which the anode is housed in the interior space of the envelope, and which is provided for extracting arriving electrons out of electrons resulting from cascade multiplication by the electron multiplier, as a signal.

A sixth aspect applicable to the above fifth aspect preferably has the following configuration: as a relation of regions facing each other between adjacent dynodes, each of a region where a single secondary electron emitting surface is formed in the peripheral surface of a column in one dynode and a region where a single secondary electron emitting surface is formed in the peripheral surface of a column in the other dynode, has a section defined by a plane including both of the first and third directions, the section having a surface shape depressed in a direction away from the other.

As a seventh aspect applicable to at least one of the above fifth and sixth aspects, the envelope may comprise a lower frame, an upper frame, and a sidewall frame. The lower frame is one at least a part of which having the installation surface is comprised of an insulating material. The upper frame is one which is arranged opposite to the lower frame and at least a part of which having a surface facing the installation surface of the lower frame is comprised of an insulating material. The sidewall frame is one which is disposed between the upper frame and the lower frame and which has a shape to surround the electron multiplier and the anode. In this seventh aspect, the electron multiplier and the anode are preferably arranged on the installation surface in a state in which they are spaced apart from each other by a predetermined distance.

As an eighth aspect applicable to at least any one of the above fifth to seventh aspects, the photomultiplier may comprise a plurality of recesses arranged in a state in which the recesses are spaced apart by a predetermined distance on the installation surface, each recess extending along the second direction on the installation surface. In this eighth aspect, each of the multistage dynodes is preferably arranged on the installation surface so that the pedestal thereof is located between the recesses.

Each of the examples according to this invention will be more fully understandable in view of the following detailed description and accompanying drawings. These examples are provided by way of illustration only and should not be construed as limiting this invention.

The scope of further application of this invention will become clear from the following detailed description. It is, however, noted that the detailed description and specific examples show the preferred examples of the invention but are presented by way of illustration only and it is apparent that various modifications and improvements within the scope of the invention are obvious to those skilled in the art from the detailed description.

BRIEF DESCRIPTION OF THE DRAWINGS

FIGS. 7A to 7C are drawings for explaining structures of the electron multiplier shown in FIG. 6 and its constituent elements, wherein FIG. 7A is a partly broken view of the electron multiplier shown in FIG. 6, FIG. 7B is a perspective view showing the shape of a column, and FIG. 7C is a perspective view showing the shape of a column surface.

FIGS. 8A to 8C are drawings for explaining the structure of columns: wherein FIG. 8*a* is a partly broken view of a column along the line I-I in FIG. 7B, FIG. 8B is a drawing showing variations where the sectional shape in FIG. 8A is realized by curves, and FIG. 8C is a drawing showing variations where the sectional shape in FIG. 8A is realized by straight lines.

FIGS. 9A to 9C are drawings for explaining a processing simulation of the column surface where a secondary electron emitting surface is formed.

FIGS. 11A to 11C are drawings showing structures of other examples of the dynodes (columns on each of which the secondary electron emitting surface is formed) installed in the photomultiplier as in FIG. 10 (corresponding to the section along the line II-II of the photomultiplier shown in FIG. 1), wherein FIG. 11A is a drawing showing a sectional shape of a conventional dynode, FIG. 11B is a drawing showing a sectional shape of a dynode according to a first modification example, and FIG. 11C is a drawing showing a sectional shape of a dynode according to a second modification example.

FIGS. 12A and 12B are drawings for explaining effects of the embodiment of the present invention (corresponding to the section along the line II-II of the photomultiplier shown in FIG. 1), wherein FIG. 12A is a drawing showing a conventional structure and FIG. 12B is a drawing showing the structure of the embodiment.

FIGS. 14A and 14B are drawings showing structures of respective portions in the photomultiplier shown in FIG. 1, wherein FIG. 14A is a bottom view from the back side of the upper frame shown in FIG. 1 and FIG. 14B is a plan view of the sidewall frame shown in FIG. 1.

FIGS. 16A and 16B are partly broken perspective views of the sidewall frame and lower frame shown in FIG. 1 (corresponding to the section along the line II-II of the photomultiplier shown in FIG. 1), wherein FIG. 16A is a drawing in which the lower frame of a first structure is applied and FIG. 16B is a drawing in which the lower frame of a second structure example is applied.

FIG. 21 is a perspective view of the lower frame in the photomultiplier according to a second modification example of the present invention, wherein

DETAILED DESCRIPTION OF THE PREFERRED EMBODIMENTS

Each of embodiments of the dynodes, electron multiplier, and photomultiplier according to the present invention will be described below in detail with reference to the accompanying drawings. In the description of drawings identical or equivalent portions will be denoted by the same reference signs, without redundant description.

Figure 1:
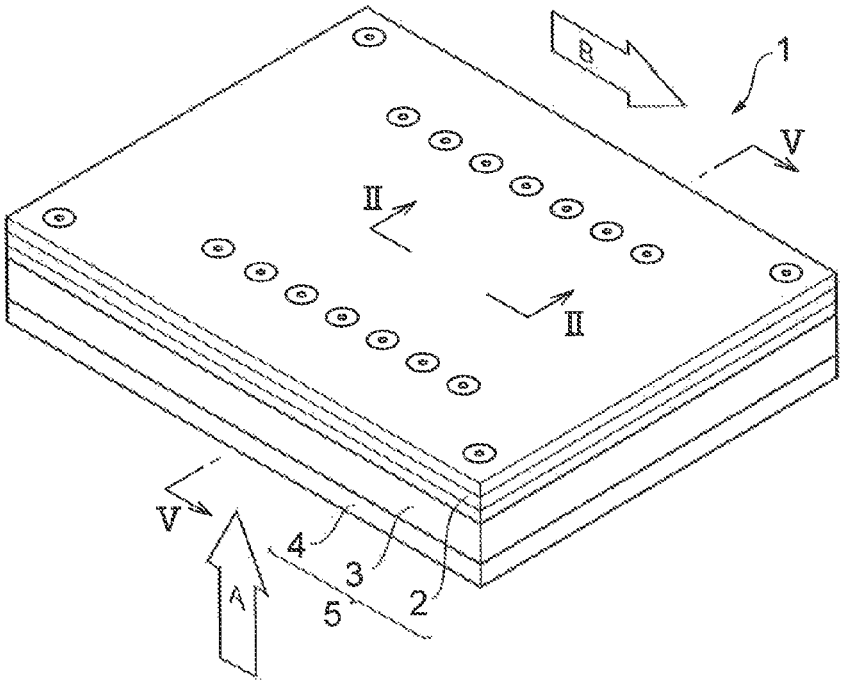
FIG. 1 is a perspective view showing a configuration of an embodiment of the photomultiplier according to the present invention.
Figure 2:
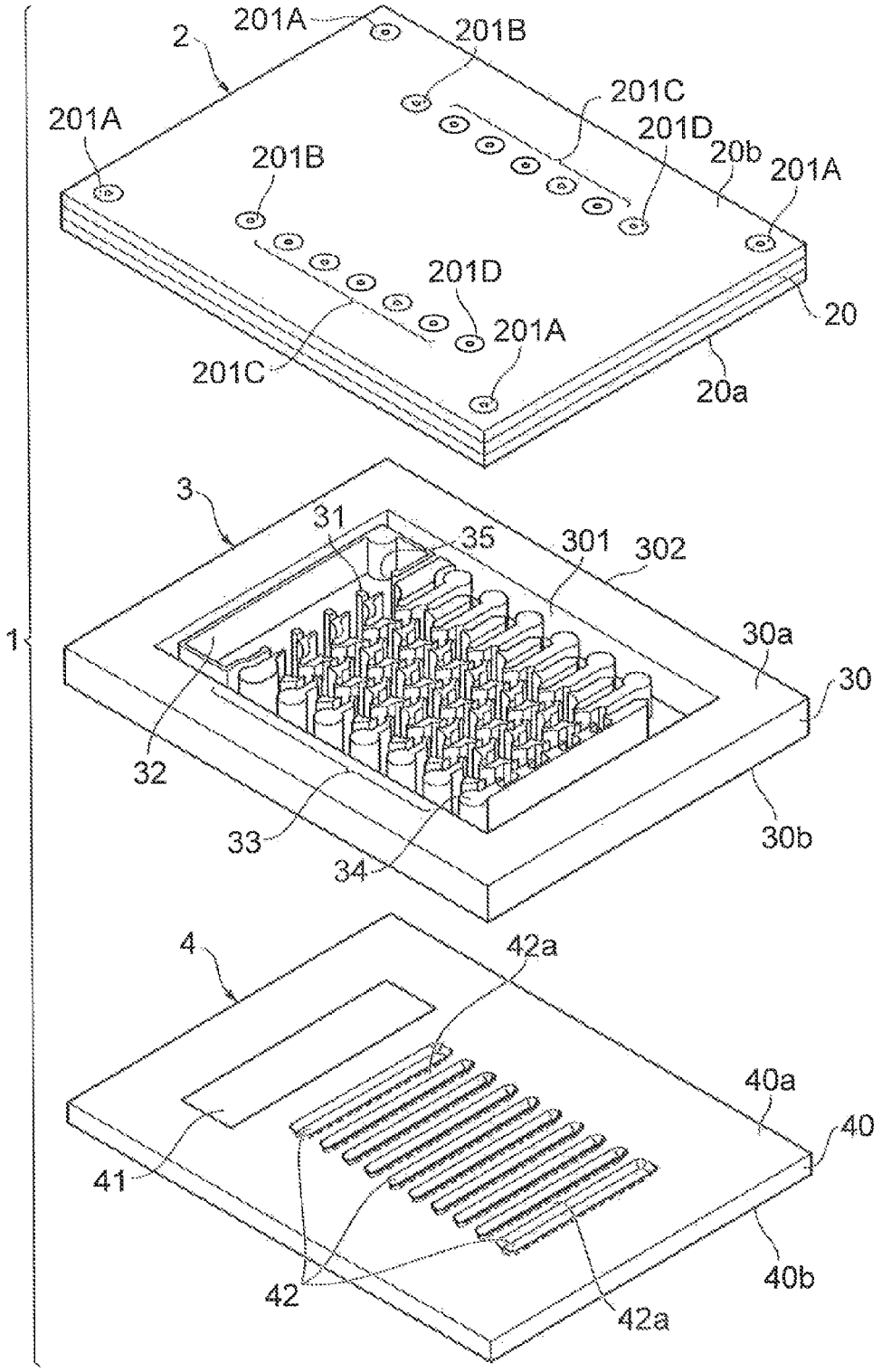
FIG. 2 is an exploded perspective view of the photomultiplier shown in FIG. 1.

FIG. 1 is a perspective view showing a configuration of an embodiment of the photomultiplier according to the present invention and FIG. 2 an exploded perspective view of the photomultiplier 1 shown in FIG. 1.

The photomultiplier 1 shown in FIG. 1 is a photomultiplier tube with a transmissive photocathode and is provided with a housing 5 as an envelope composed of an upper frame (second substrate) 2, a sidewall frame 3, and a lower frame (first substrate) 4 opposed to the upper frame 2 with the sidewall frame 3 in between. This photomultiplier 1 is an electron tube in which a direction of incidence of light to the photocathode intersects with a direction of multiplication of electrons in an electron multiplier. Namely, the photomultiplier 1 is an electron tube in which when light is incident from a direction intersecting with a plane made by the lower frame 4, which is indicated by arrow A in FIG. 1, photoelectrons emitted from the photocathode move into the electron multiplier, cascade multiplication of secondary electrons is induced in a direction intersecting with the direction indicated by arrow A, which is indicated by arrow B, and a signal is taken out from an anode.

In the description hereinafter, an upstream side (photocathode side) of electron multiplication paths (electron multiplication channels) along the electron multiplication direction will be referred to as "first end side" and a downstream side (anode side) thereof as "second end side." Each of the constituent elements of the photomultiplier 1 will be described below in detail.

As shown in FIG. 2, the upper frame 2 is comprised of a base material of wiring substrate 20 whose major material is an insulating ceramic of a rectangular flat plate shape. An example of such a wiring substrate to be used is a multilayer wiring substrate using LTCC (Low Temperature Co-fired Ceramics) or the like allowing fine wiring design and free design of wiring patterns on the front and back. The wiring substrate 20 has a plurality of conductive terminals 201A-201D on its principal surface 20*b*, which are electrically connected to the sidewall frame 3, below-described photocathode 41, focusing electrode 31, wall electrode 32, electron multiplier 33, and anode 34 so as to implement power feeding from the outside and extraction of signal. The conductive terminals 201A are provided for power feeding to the sidewall frame 3; the conductive terminals 201B are provided for power feeding to the photocathode 41, focusing electrode 31, and wall electrode 32; the conductive terminals 201C are provided for power feeding to the electron multiplier 33; the conductive terminals 201D are provided for power feeding to the anode 34 and extraction of signal. These conductive terminals 201A-201D are connected respectively to conductive films and conductive terminals (the details of which will be described below) on an insulating opposite surface 20*a* opposite to the principal surface 20*b* in the wiring substrate 20, and these conductive films and conductive terminals are connected to the sidewall frame 3, photocathode 41, focusing electrode 31, wall electrode 32, electron multiplier 33, and anode 34. The upper frame 2 does not always have to be limited to the multilayer wiring substrate provided with the conductive terminals 201, but it may be a platelike member of an insulating material such as a glass substrate, through which the conductive terminals for power feeding from the outside and extraction of signal are provided.

The sidewall frame 3 is comprised of a base material of a silicon substrate 30 of a rectangular flat plate shape. A penetrating part 301 surrounded by a frame-like sidewall part 302 is formed from a principal surface 30*a* of the silicon substrate 30 toward a surface 30*b* opposed thereto. This penetrating part 301 is formed so as to have a rectangular aperture and the periphery thereof along the periphery of the silicon substrate 30.

In this penetrating part 301, there are the wall electrode 32, focusing electrode 31, electron multiplier 33, and anode 34 arranged from the first end side toward the second end side. These wall electrode 32, focusing electrode 31, electron multiplier 33, and anode 34 are formed by processing the silicon substrate 30 by RIE (Reactive Ion Etching) processing or the like, and a major material thereof is silicon.

The wall electrode 32 is an electrode of a frame shape formed so as to surround the below-described photocathode 41, when viewed from a direction normal to an opposite surface 40*a* of below-described glass substrate 40 (which is a direction approximately perpendicular to the opposite surface 40*a*). The focusing electrode 31 is an electrode that focuses photoelectrons emitted from the photocathode 41 and guides them to the electron multiplier 33, and is disposed between the photocathode 41 and the electron multiplier 33.

The electron multiplier 33 is composed of N stages (N is an integer of 2 or more) of dynodes (electron multiplying portions) set at different potentials along the electron multiplication direction from the photocathode 41 to the anode 34 (which is the direction indicated by arrow B in FIG. 1 and which will be the same hereinafter), and has a plurality of electron multiplication paths (electron multiplication channels) extending across each of the stages in the electron multiplication direction. The anode 34 is located at a position where the electron multiplier 33 is sandwiched between the anode 34 and the photocathode 41.

Each of these wall electrode 32, focusing electrode 31, electron multiplier 33, and anode 34 is fixed to the lower frame 4 by anodic bonding, diffusion bonding, or bonding with a seal material such as a low-melting-point metal (e.g., indium), whereby they are two-dimensionally arranged on the lower frame 4.

The lower frame 4 is comprised of a base material of glass substrate 40 of a rectangular flat plate shape. This glass substrate 40 forms the opposite surface 40*a* of glass as an insulating material that is opposed to the opposite surface 20*a* of the wiring substrate 20 and that is an internal surface of the housing 5. The photocathode 41 of a transmissive photoelectric surface is formed in a portion opposite to the penetrating part 301 of the sidewall frame 3 (which is a portion except for a bonding region to the sidewall part 302) and at an end on the side opposite to the anode 34 side, on the opposite surface 40*a*. A plurality of recesses 42 of a rectangular shape are formed in a portion where the electron multiplier 33 and anode 34 are mounted on the opposite surface 40*a*, in order to prevent multiplied electrons from entering the opposite surface 40*a*. The multistage dynodes constituting the electron multiplier 33, and the anode 34 are arranged on intermediate portions 42*a* which are flat portions between the recesses 42.

Figure 3:
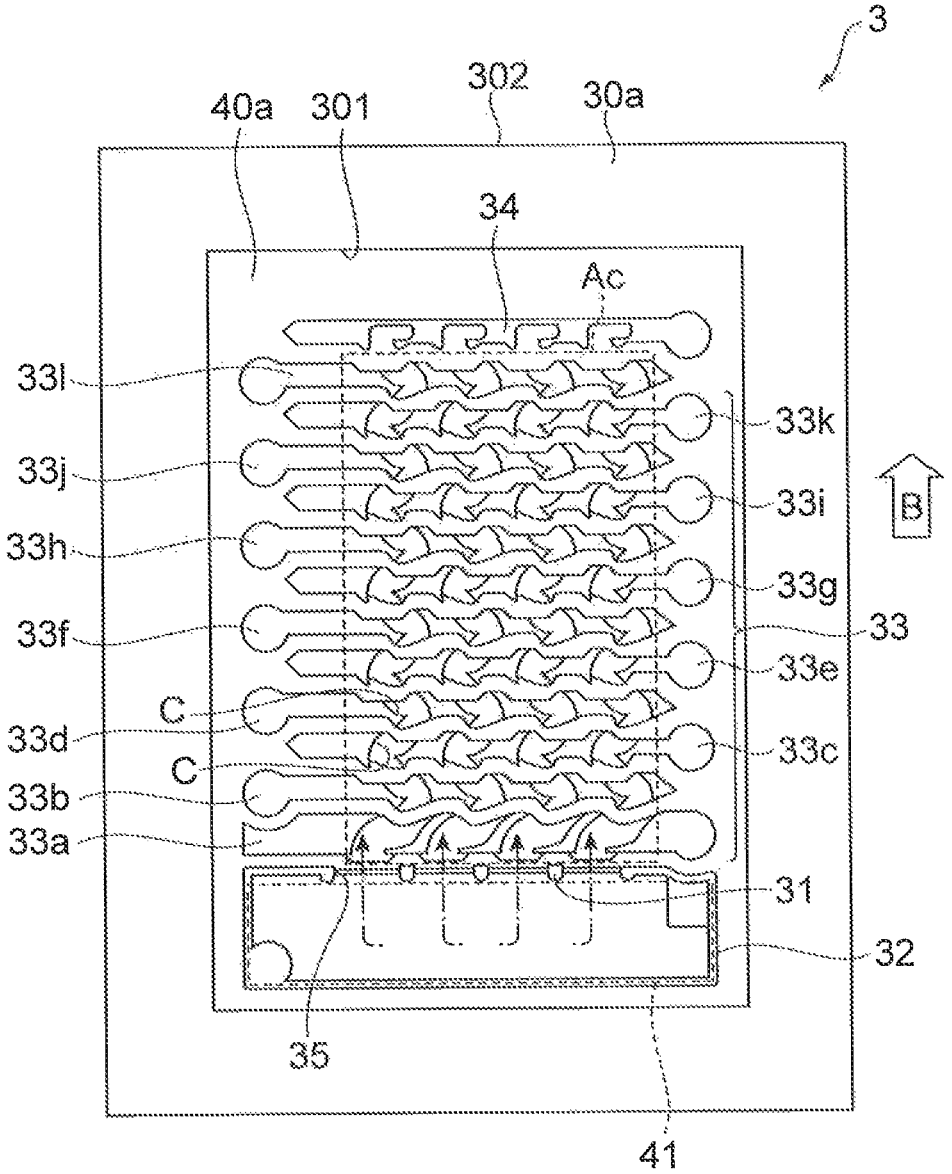
FIG. 3 is a plan view of a sidewall frame shown in FIG. 1.

Next, the internal structure of the photomultiplier 1 will be described in detail with reference to FIGS. 3 to 5. FIG. 3 is a plan view of the sidewall frame 3 shown in FIG. 1, FIG. 4 a partly broken perspective view showing the major parts of the sidewall frame 3 and lower frame 4 shown in FIG. 1 (including a section along the line II-II of the photomultiplier in FIG. 1), and FIG. 5 a sectional view along the line V-V of the photomultiplier shown in FIG. 1.

As shown in FIG. 3, the electron multiplier 33 in the penetrating part 301 is composed of multistage dynodes 33*a*-33*l* arranged in order as spaced apart, from the first end side to the second end side on the opposite surface 40*a* (in the direction indicated by arrow B, which is the electron multiplication direction). These multistage dynodes 33*a*-33*l* form a plurality of parallel electron multiplication channels C each consisting of N electron multiplication holes provided in series from the first-stage dynode 33*a* on the first end side to the last-stage (Nth) dynode 33*l* on the second end side along the direction indicated by arrow B. The recesses 42 are provided between the focusing electrode 31 and the first-stage dynode 33*a*, between each pair of adjacent two of the multistage dynodes 33*a*-33*l*, and between the last-stage dynode 33*l* and the anode 34, and the multistage dynodes 33*a*-33*l* are arranged on the respective intermediate portions 42*a* being the flat portions located between the recesses 42 provided in the lower frame 2 in FIG. 2.

The photocathode 41 is provided with a space from the first-stage dynode 33*a* on the first end side and located on the first end side on the opposite surface 40*a* with the focusing electrode 31 in between. This photocathode 41 is formed as a transmissive photoelectric surface of a rectangular shape on the opposite surface 40*a* of the glass substrate 40. When incident light from the outside passing through the glass substrate 40 of the lower frame 4 reaches the photocathode 41, it emits photoelectrons according to the incident light and the photoelectrons are guided to the first-stage dynode 33*a* by the wall electrode 32 and the focusing electrode 31.

The anode 34 is provided with a space from the last-stage dynode 33*l* on the second end side and located on the second end side on the opposite surface 40*a*. This anode 34 is an electrode for extracting electrons resulting from the multiplication in the direction indicated by arrow B in the electron multiplication channels C by the electron multiplier 33, as an electric signal to the outside, and has a plurality of depressions corresponding to the respective electron multiplication channels C. Each depression, when viewed from a direction perpendicular to the opposite surface 40*a* of the lower frame 4, is of a saclike shape open on one sidewall face side facing the electron multiplier 33 and closed on the other sidewall face side, and is provided with a projecting portion to narrow an entrance space, at an entrance of the depression on the one sidewall face side. Namely, the anode 34 is shaped so as to confine the multiplied electrons entering the depressions, whereby the anode 34 can extract the multiplied electrons as a signal with greater certainty. There is also the recess 42 between the anode 34 and the sidewall part 302 opposed to a second-end side face of the anode 34, and the anode 34 is arranged on the intermediate portion 42*a* being the flat portion located between recesses 42.

Figure 4:
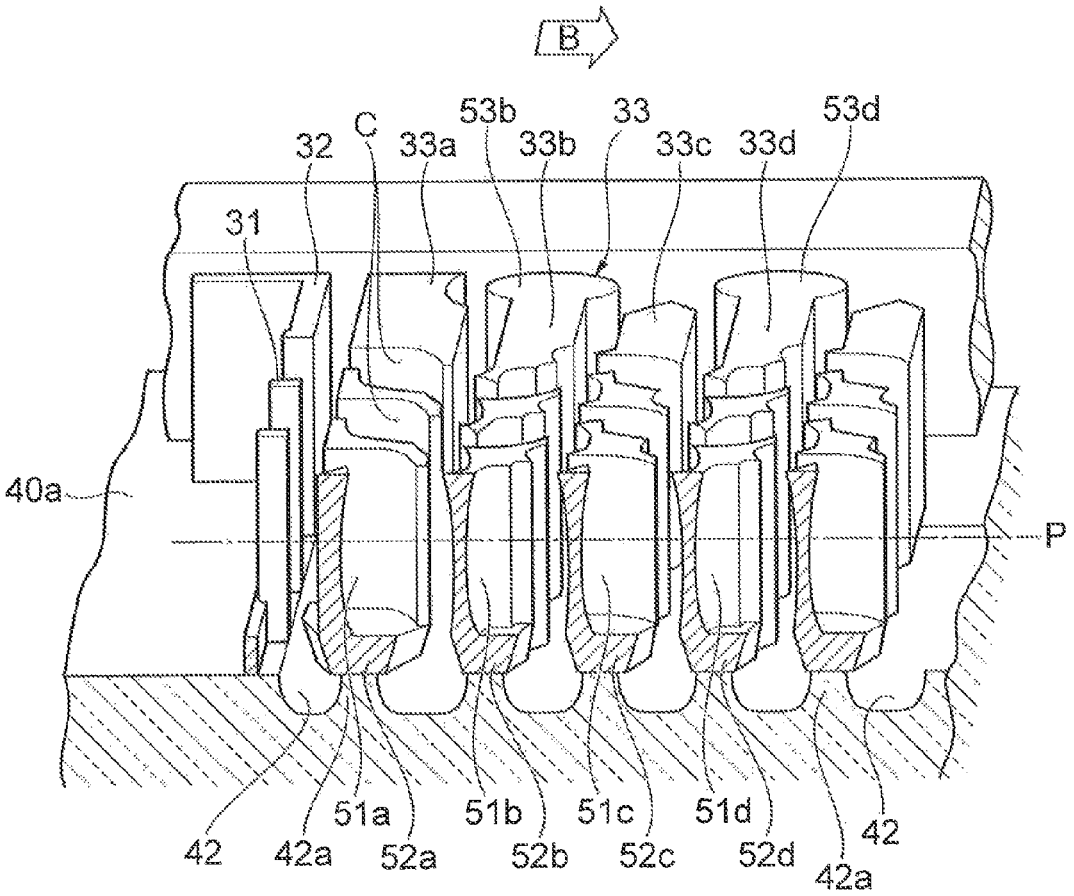
FIG. 4 is a partly broken perspective view showing major parts of the sidewall frame and lower frame shown in FIG. 1 (including a section along the line II-II of the photomultiplier shown in FIG. 1).

As shown in FIG. 4, each of the multistage dynodes 33*a*-33*d* is arranged on the intermediate portion 42*a* of the flat portion located between recesses 42 formed on the opposite surface 40*a* of the lower frame 4 and is separated from bottoms of the respective recesses 42. The dynode 33*a* includes a plurality of columns 51*a* arranged in a direction approximately perpendicular to the electron multiplication direction and along the opposite surface 40*a* and extending nearly perpendicularly toward the opposite surface 20*a* of the upper frame 2, and a pedestal (support) 52*a* (330) continuously formed at ends on the recess 42 side of the columns 51*a* (51) and extending in a direction approximately perpendicular to the electron multiplication direction and along the bottoms of the recesses 42. Furthermore, the dynodes 33*b*-33*d* also have the same structure as the dynode 33*a*, as to the columns 51*b*-51*d* and pedestal 52*b*-52*d*, respectively. The electron multiplication channels C are formed between adjacent members in the respective columns 51*a*-51*d* and the pedestals 52*a*-52*d* are disposed across a region $A_c$ (FIG. 3) where the electron multiplication channels C are formed. The pedestals 52*a*-52*d* function each to electrically connect the plurality of columns 51*a*-51*d*, respectively, and to keep the plurality of columns 51*a*-51*d* separate from the bottoms of the recesses 42. In the present embodiment, each of the dynodes 33*a*-33*d* is configured so that the columns 51*a*-51*d* and the pedestal 52*a*-52*d* are integrally formed, but the columns and pedestal may be separately formed. Secondary electron emitting surfaces are formed in predetermined regions of the respective columns 51*a*-51*d* and sectional shapes of these columns 51*a*-51*d* are designed to minimize the width near an x-y plane P located approximately in the middle between the lower frame 4 and the upper frame 2 (or on the side nearer to the lower frame 4), as shown in FIG. 4. Although not shown, the dynodes 33*e*-33*l* also have the same structure.

Furthermore, at one end in the direction perpendicular to the electron multiplication direction in each of the pedestals 52*b*, 52*d*, a power feeding portion 53*b*, 53*d* of a nearly cylindrical shape is formed integrally with the pedestal 52*b*, 52*d* so as to extend approximately perpendicularly from the end toward the upper frame 2. The power feeding portions 53*b*, 53*d* are members for feeding power to the columns 51*b*, 51*d* via the pedestals 52*b*, 52*d*, respectively. The other dynodes also have the same structure.

Figure 5:
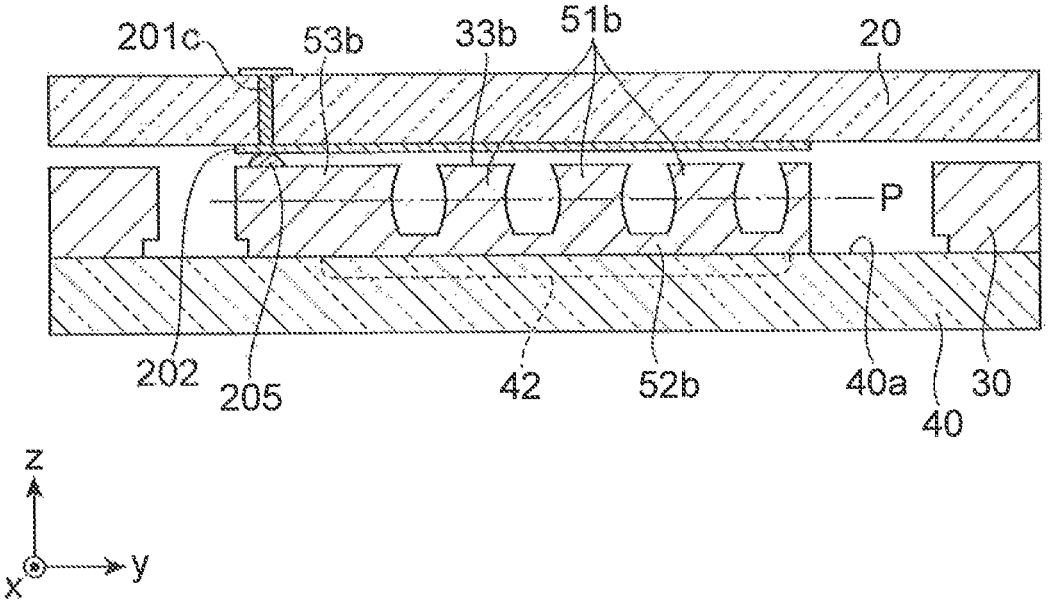
FIG. 5 is a sectional view along the line V-V of the photomultiplier shown in FIG. 1.

As shown in FIG. 5, the dynode 33*b* is secured to the lower frame 4 in such a manner that a lower surface of the pedestal 52*b* extending in the direction perpendicular to the electron multiplication direction and along the opposite surface 40*a* is bonded to the intermediate portion 42*a* of the flat portion of the opposite surface 40*a*. Although there are some differences in detailed shape, the other dynodes 33*a*, 33*c*-33*l* also have the same basic structure as to the columns, pedestal, and power feeding portion. In correspondence to this structure, the recesses 42 on the opposite surface 40*a* are formed in a width slightly larger than the arrangement spacing of the pedestals of the multistage dynodes 33*a*-33*l* and the anode 34. Namely, the recesses 42 are intermittently formed via the intermediate portions 42*a* of flat portions in the opposite surface 40*a* of the lower frame 4, so as to increase creeping distances between the pedestals of the dynodes 33*a*-33*l* and the anode 34. The secondary electron emitting surfaces are formed in the columns 51*b* and the sectional shape of these columns 51*b* is designed to minimize the width near the x-y plane P located approximately in the middle between the lower frame 4 and the upper frame 2, as shown in FIG. 5.

The shape of the columns forming each of the multistage dynodes 33*a*-33*l*, particularly, the shape of the secondary electron emitting surfaces will be described below in detail.

Figure 6:
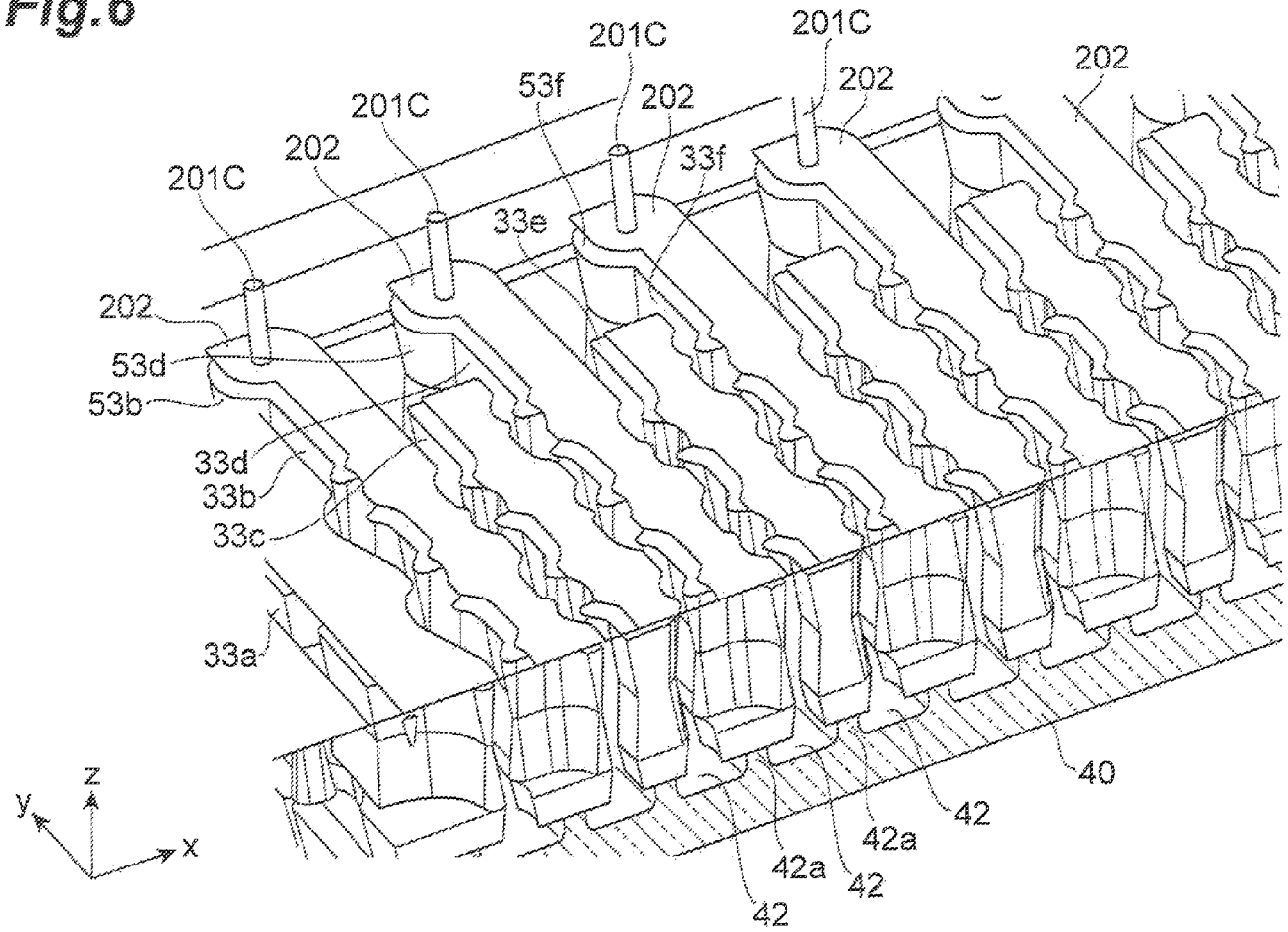
FIG. 6 is a partly broken perspective view of the sidewall frame and lower frame shown in FIG. 1, particularly, in a region near the electron multiplier.
Figure 7B:
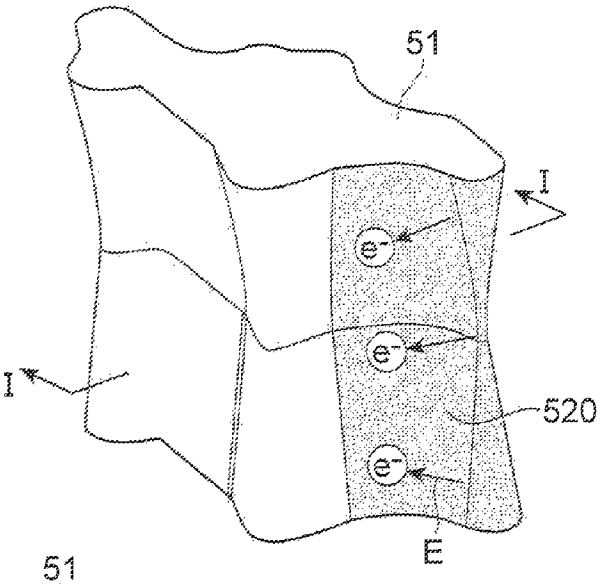
Figure 7C:
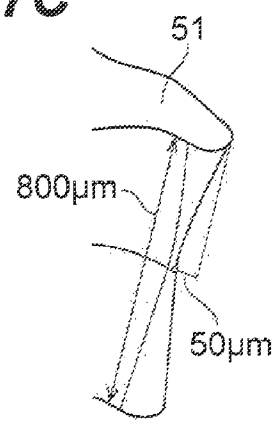
Figure 7A:
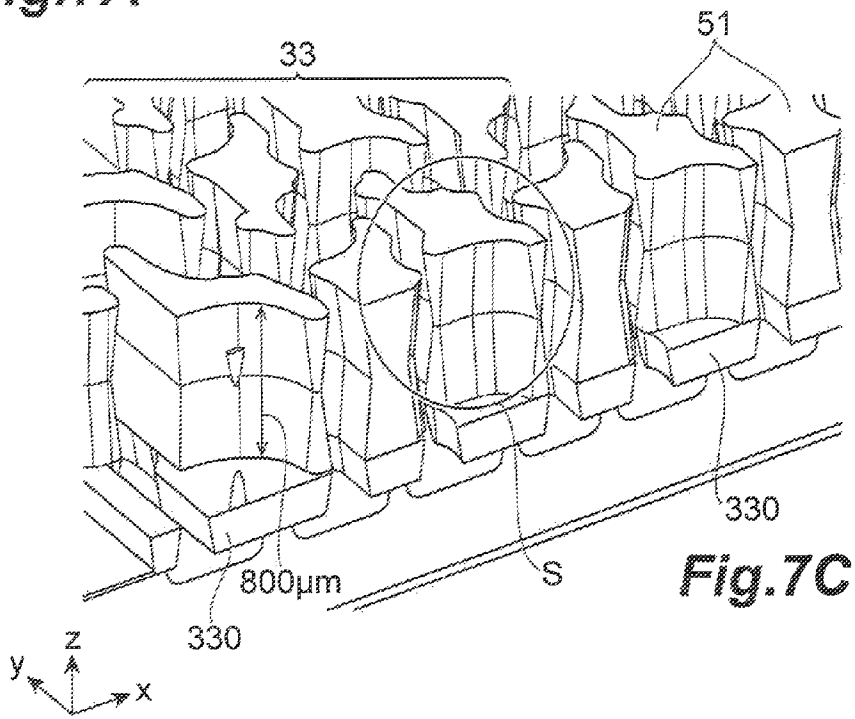
Figure 8A:
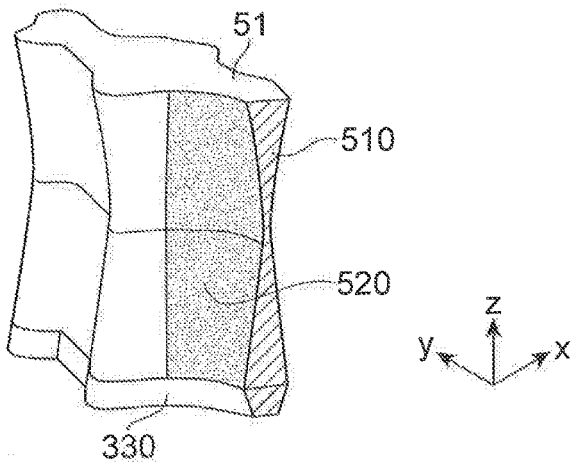
Figure 8B:
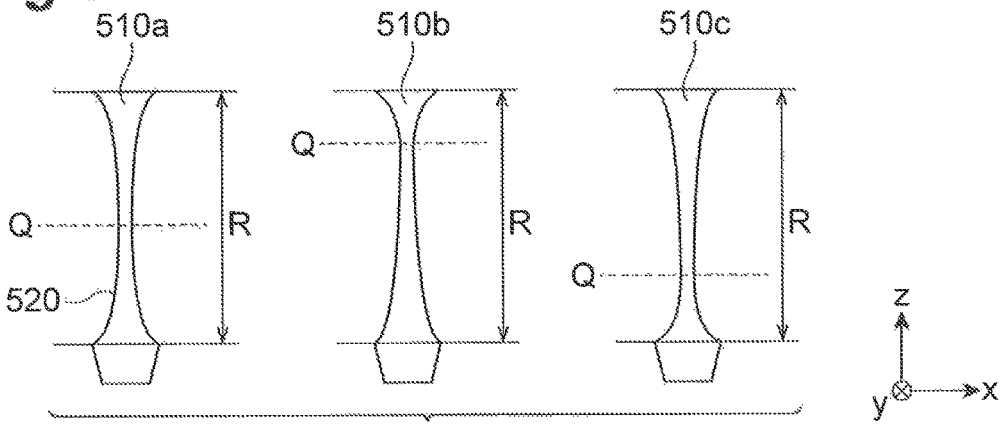
Figure 8C:
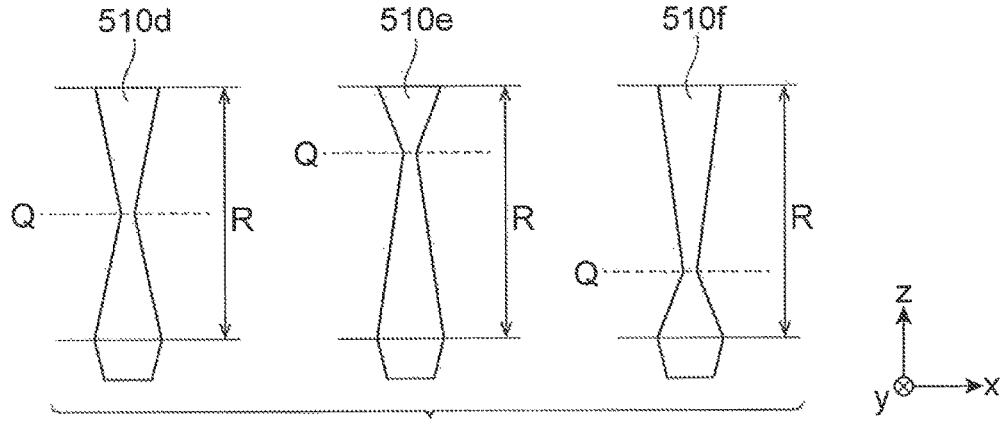

FIG. 6 is a partly broken perspective view of the sidewall frame and lower frame shown in FIG. 1, particularly, in a region near the electron multiplier. FIGS. 7A to 7C are drawings for explaining the structure of the electron multiplier and constituent elements thereof shown in FIG. 6, wherein FIG. 7A is a partly broken view of the electron multiplier in FIG. 6, FIG. 7B a perspective view showing the shape of the column at a location indicated by S in FIG. 7A, and FIG. 7C a perspective view showing the shape of the surface of the column. FIGS. 8A to 8C are drawings for explaining the structure of the column, wherein FIG. 8A is a partly broken view of the column along the line I-I in FIG. 7B, FIG. 8B a drawing showing variations where the sectional shape in FIG. 8A is realized by curves, and FIG. 8C a drawing showing variations where the sectional shape in FIG. 8A is realized by straight lines. FIGS. 9A to 9C are drawings for explaining a processing simulation of the surface of the column on which the secondary electron emitting surface is formed, wherein FIG. 9A shows a processing region of the column, FIG. 9B shows a minimum processing element in FIG. 9A, and FIG. 9C is a drawing showing a progress of a processing process with the lapse of time.

FIG. 6 shows the structure near the electron multiplier 33 so that the x-axis in the drawing is included in the section along the line II-II in FIG. 1. Namely, the plurality of recesses 42 are provided on the opposite surface 40*a* of the lower frame 40 (glass substrate) and the multistage dynodes 33*a*-33*l* are arranged on the respective intermediate portions 42*a* located between these recesses 42. The side faces of the respective pedestals of the multistage dynodes 33*a*-33*l* are processed in a curved shape or a tapered shape. The conductive films 202 (evaporated electrodes for countermeasures against hysteresis) provided on the opposite surface 20*a* of the upper frame 2 are connected to the respective conductive terminals 201C and a conductive material 205 (described below) electrically connects the conductive film 202 to the power feeding portion 53*a*-53*l* of each of the multistage dynodes 33*a*-33*l*.

As shown in FIG. 7A, the side faces of the pedestals 330 of the multistage dynodes 33*a*-33*l* are processed in a tapered shape to become thinner in the direction from the upper frame 2 to the lower frame 4. When the side faces are processed in this manner, the distance between adjacent dynodes is increased. Furthermore, the recess 42 is provided between adjacent dynodes, thereby to further increase the creeping distance between adjacent dynodes, which is defined on the opposite surface 40*a* of the lower frame 4. The region where the secondary electron emitting surface 520 of each column 51 is formed has, as shown in FIG. 7B, such a shape that normal vectors to respective portions of the secondary electron emitting surface 520 are directed to an intermediate point of the column 51 (position intersecting with the x-y plane P in FIG. 5). The directions of the normal vectors shown in FIG. 7B are directions of emission of secondary electrons with the highest emission probability. In the present embodiment example, the height of the column 51 (length along the direction from the lower frame 4 to the upper frame 2) is 800 μm, and the region where the secondary electron emitting surface of this column 51 is formed has a constricted structure in which the intermediate position along the height direction of the column 51 (the position intersecting with the x-y plane P in FIG. 5) is located 50 μm inward into the interior of the column 51.

Namely, as shown in FIGS. 6 and 7A-7C, each of the columns 51 (corresponding to 51*a*-51*l*) forming the respective stages of dynodes 33*a*-33*d* is processed so that the section thereof perpendicular to the opposite surface 40*a* of the lower frame 4 (which will be referred to hereinafter as vertical section and which corresponds to the x-z plane), specifically, the shape of the region R where the secondary electron emitting surface 520 is formed, is depressed in a curved or tapered shape along the z-axis direction (cf. FIGS. 6 and 7A). For example, as shown in FIGS. 7B and 7C, the height of each column (in the z-axis direction) is 800 μm, and the shape of the region where the secondary electron emitting surface is formed is processed to the constricted shape depressed by 50 μm from each end (the end located on the lower frame 4 side and the end located on the upper frame 2 side), at the intermediate point (position intersecting with the x-y plane P in FIG. 5).

FIG. 8A shows an example of the vertical section (x-z plane) of each column 51. It is noted that the section 510 (hatched portion) of the column 51 in this FIG. 8A is the vertical section along the line I-I in FIG. 7B. For processing of this vertical section, for example, the secondary electron emitting surface 520 may be processed as defined by curves, as shown in FIG. 8B, or the secondary electron emitting surface 520 may be processed as defined by straight lines, as shown in FIG. 8C.

Namely, in the photomultiplier 1 of the present embodiment, as shown in FIGS. 8A to 8C, each of the multistage dynodes 33*a*-33*l* is formed so that the region where the secondary electron emitting surface is formed has the constricted structure. More specifically, in the section (x-z plane) along the line II-II in FIG. 1, the region R where the secondary electron emitting surface 520 is formed has the shape to minimize the width in the x-axis direction (direction indicated by arrow B), for example, at a certain position Q of the column 51 (the same also applies to the other columns). In the section (x-z plane) along the line II-II in FIG. 1, the region R where the secondary electron emitting surface 520 is formed has one or more constricted shapes. Each constricted shape is such a shape that the width in the x-axis direction decreases monotonically and then increases monotonically in the direction from the lower frame 4 to the upper frame 2. Furthermore, for example, the secondary electron emitting surface of the dynode 33*a* has the section (x-z plane) along the line II-II in FIG. 1, which is defined by line segments including one or more depressed shapes entering into the column 51. When the sectional shape of the column 51 is viewed along the x-y plane, an area or a peripheral length of the section becomes minimum at the position Q in the region R where the secondary electron emitting surface 520 is formed.

In FIGS. 8B and 8C, the position Q of "constriction" (which is the portion with the minimum width along the x-axis direction of the section) in each of the sections 510*a*, 510*d* corresponds to the intermediate point of the region R where the secondary electron emitting surface 520 is formed. The position Q of "constriction" (portion with the minimum width along the x-axis direction of the section) in each of the sections 510*b*, 510*e* is located on the upper side (at a position nearer to the upper frame 2 than the intermediate point) in the region R where the secondary electron emitting surface 520 is formed. The position Q of "constriction" (region with the minimum width along the x-axis direction of the section) in each of the sections 510*c*, 510*f* is located on the lower side (region nearer to the lower frame 4 than the intermediate point) in the region R where the secondary electron emitting surface 520 is formed.

In any one of the variations, the portion Q with the smallest width of the vertical section 510 of each column 51 is present in the region R where the secondary electron emitting surface is formed. In the region R, a vertical section of each column along the y-axis direction (corresponding to the y-z plane) also decreases monotonically and then increases monotonically from the portion indicated by Q in the drawing, along the height direction of each column (z-axis direction) extending from the lower frame 4 to the upper frame.

The columns 51 with the vertical section as described above can be formed, for example, by etching as shown in FIGS. 9A to 9C. FIG. 9A shows a part of the column 51 (a region indicated by region AR in FIG. 9A) having the vertical section 510*d*. The secondary electron emitting surface 520 is formed in the etched region. FIG. 9C is a drawing showing the result of a processing simulation, in which a progress of etching is shown with the lapse of time. Each of sections 900A-900R in FIG. 9C is composed of minimum processing elements shown in FIG. 9B. As understood from the minimum processing elements shown in this FIG. 9B, the etched surface is curved. Furthermore, numeral 910 represents an etching mask in each of the sections 900A-900R in FIG. 9C. In addition, numeral 920 represents an internal protecting film to be filled so as to function as an etching mask, in a region being etched along an intended line 521 of etching.

Figure 10:
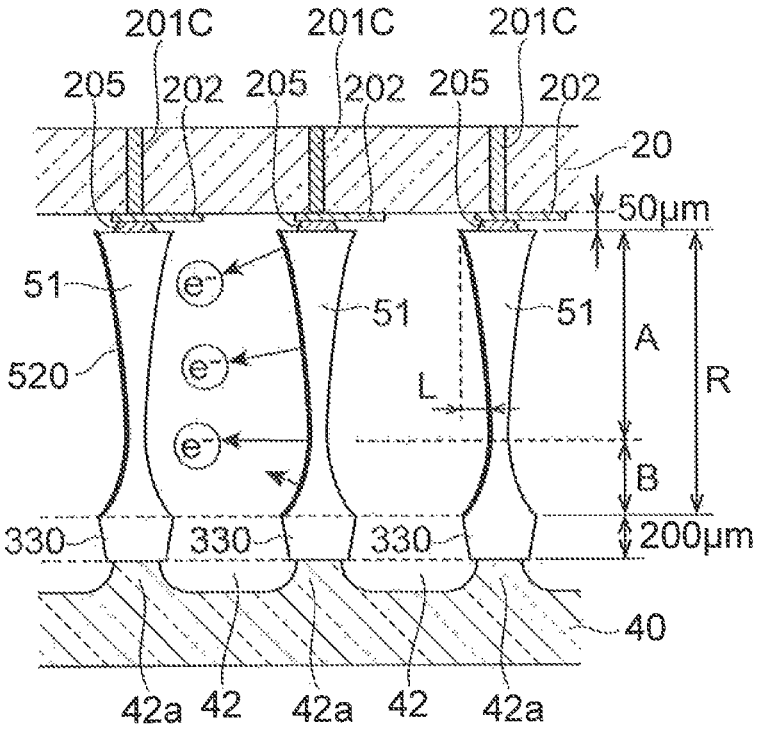
FIG. 10 is a section along the line II-II of the photomultiplier shown in FIG. 1, and a drawing for explaining a specific installation state of an example of dynodes (columns on each of which the secondary electron emitting surface is formed) forming a part of the electron multiplier.
Figure 11A:
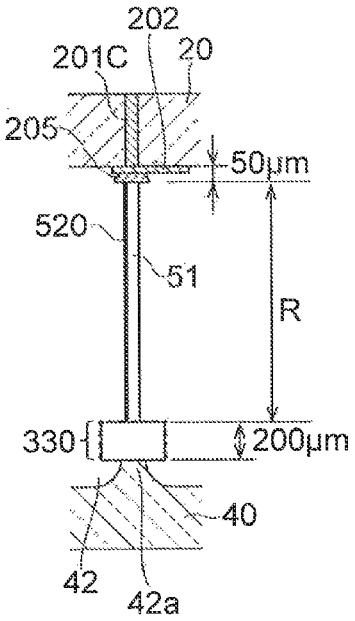
Figure 11B:
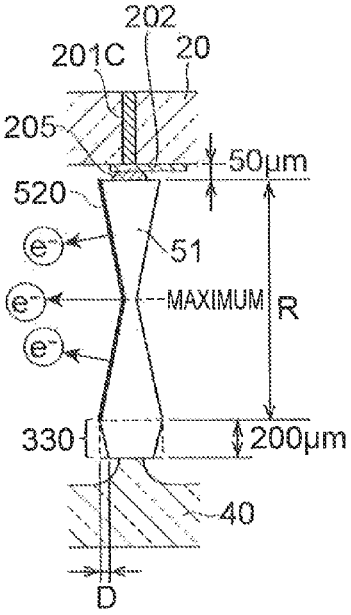
Figure 11C:
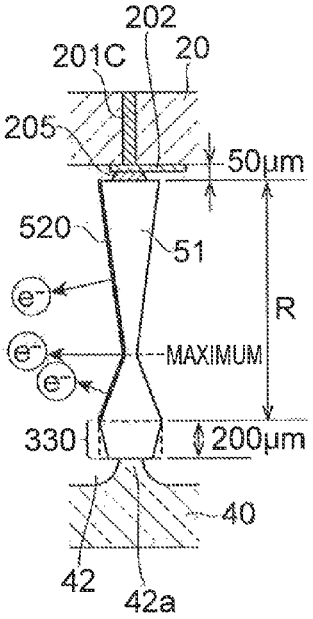

Next, specific installation states of the columns 51 which can be realized by the various sectional shapes as described above will be described below with reference to FIGS. 10 and 11A-11C. FIG. 10 is a section along the line I-II of the photomultiplier 1 in FIG. 1 and a drawing for explaining a specific installation state of an example of dynodes 33*a*-33*l* (columns 51 where the secondary electron emitting surfaces are formed) forming a part of the electron multiplier 33. FIGS. 11A-11C are drawings (corresponding to the section along the line II-II of the photomultiplier 1 in FIG. 1) showing structures of other examples of the dynodes 33*a*-33*l* (columns 51 where the secondary electron emitting surfaces are formed) installed in the photomultiplier 1 as in FIG. 10, wherein FIG. 11A is a drawing showing a sectional shape of a conventional dynode, FIG. 11B a drawing showing a sectional shape of a dynode according to a first modification example, and FIG. 11C a drawing showing a sectional shape of a dynode according to a second modification example. It is assumed in the examples of FIGS. 10 and 11A-11C that the upper frame 2 is comprised of a glass substrate 20.

As shown in FIG. 10, the glass substrate 40 of the lower frame 4 is provided with a plurality of recesses 42 on its opposite surface 40*a* and the pedestals 330 (with the thickness of 200 μm) of the respective stages of dynodes are installed on the respective intermediate portions 42*a* located between these recesses 42. On each pedestal 330 the columns 51 with the secondary electron emitting surface being formed on the side face thereof are installed integrally with the pedestal 330. These integrated pedestal 330 and columns 51 constitute each stage of dynode. On the other hand, in the glass substrate 20 of the upper frame 2, the conductive terminals 201C are in contact with the respective conductive films 202 evaporated on the opposite surface 20*a* of the glass substrate 20, and each conductive film 202 is electrically connected through the conductive material 205 to the top part of each column 51 (in practice, to the power feeding portion 53*a*-53*l* of each stage of dynode). In this structure, the glass substrate 20 and the top part of each column 51 are separated by 50 μm.

The shape of the region R where the secondary electron emitting surface 520 of each column 51 shown in FIG. 10 is formed has a constricted structure (shape entering into the column 51 by L) at a position nearer to the lower frame 2 than the intermediate position of the region R. Namely, a region A above the position of constriction is wider than a region B below the position of constriction. Specifically, the length in the height direction of the region R where the secondary electron emitting surface 520 is formed is 800 μm, and a ratio (A:B) of the length in the height direction of the region A to the length in the height direction of the region B can be in the range of 1:1 to 10:1 and, preferably, in the range of 3:2 to 7:1. The depth C to define the constricted structure can be in the range of 20 μm to 150 μm and, preferably, in the range of 30 μm to 80 μm.

FIG. 11A shows an installation state of a dynode to which the conventional sectional shape is applied, which is the same as the installation state shown in FIG. 10, except for the sectional shape of the column 51. FIG. 11B shows an installation state of a dynode according to the first modification example, which is different in the sectional shape of the pedestal 330 and the sectional shape of the column 51, from the structure shown in FIG. 10. Namely, in the example shown in FIG. 11B, the side face of the pedestal 330 is processed in a tapered shape. The position of constriction in the column 51 is located near the intermediate point of the region R where the secondary electron emitting surface 520 is formed (a maximum point where emitted secondary electrons are concentrated is also located near the intermediate point). The example shown in FIG. 11C is different from the structure shown in FIG. 10, in that the side face of the pedestal 330 is processed in a tapered shape. Furthermore, in the installation state of FIG. 11C, the position of constriction in the column 51 is located on the lower side (glass substrate 40 side) with respect to the intermediate point of the region R where the secondary electron emitting surface 520 is formed, and, naturally, a maximum point where emitted secondary electrons are concentrated is also located on the lower side with respect to the intermediate point.

When the length of the secondary electron emitting surface 520 in the height direction of the column 51 is defined as 2*a* in FIG. 11A, the length of the secondary electron emitting surface 520 in FIG. 11B is 2.83a and the length of the secondary electron emitting surface 520 in FIG. 11C is 2.92a. When the structure shown in FIG. 11C is employed in this manner, it offers an effect of increase in the area of the secondary electron emitting surface 520 itself. It also has an effect of suppressing occurrence of black silicon (needlelike foreign matter) during manufacture. Furthermore, since the maximum point where emitted secondary electrons are concentrated can be located away from the glass substrate (particularly, from the glass substrate 20 of the upper frame 2), it is feasible to suppress unwanted luminescence and, particularly, to prevent noise which can be produced by the luminescence passing through the separate space between the glass substrate 20 and the tops of the columns 51 to reach the photocathode 41. It is also feasible to suppress reduction in withstand voltage characteristic between the conductive films 202 due to incidence of secondary electrons into the glass substrate 20 of the upper frame 2. In addition, since the creeping distance between adjacent dynodes can be increased by the degree of the length D illustrated in the pedestal 330 in FIG. 11B, in the examples of FIGS. 11B and 11C, it is feasible to achieve drastic improvement in withstand voltage characteristic.

Figure 12A:
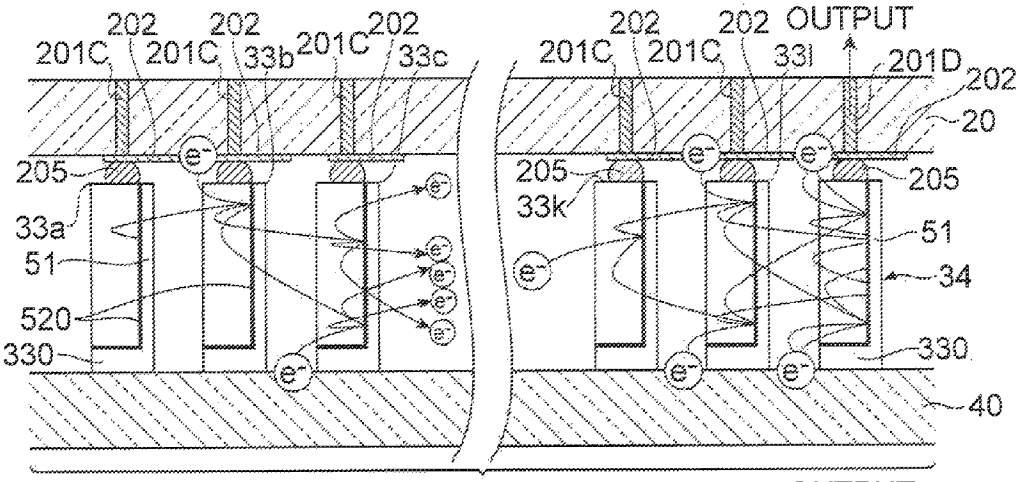
Figure 12B:
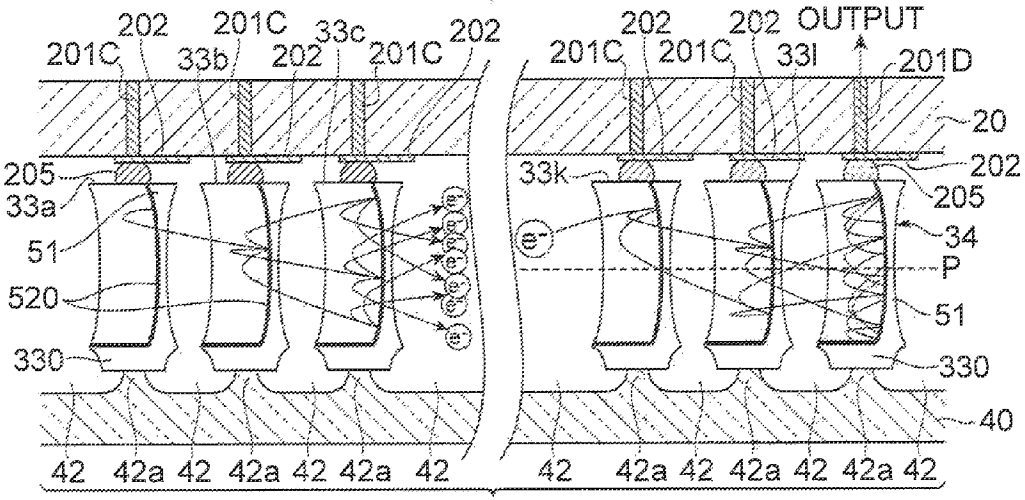

The effects of the columns 51 processed as described above will be described below using FIGS. 12A and 12B. FIGS. 12A and 12B are drawings for explaining the effects of the present embodiment (corresponding to the section along the line II-II of the photomultiplier in FIG. 1), wherein FIG. 12A shows the conventional structure and FIG. 12B is a drawing showing the structure of the present embodiment. The left side of FIG. 12A and the left side of FIG. 12B show some of the respective stages of dynodes forming the central part of the electron multiplier 33. On the other hand, the right side of FIG. 12A and the right side of FIG. 12B show some of the respective stages of dynodes forming the rear stage side of the electron multiplier 33 including the anode 34.

In the case of the conventional structure shown in FIG. 12A (in which the width of the vertical section of the columns 51 is constant along the height direction), the pedestals 330 of the respective stages of dynodes are installed on the glass substrate 40 of the lower frame 4. The columns 51 with the secondary electron emitting surface being formed on the side face thereof, are installed on the pedestals 330, integrally with the pedestals 330. These integrated pedestal 330 and columns 51 constitute each stage of dynode. On the other hand, in the glass substrate 20 of the upper frame 2, the conductive terminals 201C are in contact with the respective conductive films 202 evaporated on the opposite surface 20*a* of the glass substrate 20 and each conductive film 202 is electrically connected through the conductive material 205 to the top part of each column 51 (in practice, to the power feeding portion 53*a*-53*l* of each stage of dynode). The anode 34 is also composed of the pedestal and columns and extracts the arriving secondary electrons as a signal through the conductive terminal 201D.

In the example of FIG. 12A, the secondary electron emitting surfaces 520 (electrodes) are perpendicular to the glass substrate 40 (lower frame 4). In this case, many secondary electrons collide with the surfaces of the insulating support substrate (lower frame 4) and the penetrating electrode substrate (upper frame 2), i.e., with the surfaces of glass being an insulating material, so as to produce unwanted luminescence. This luminescence becomes a noise source and, in light sensors employing the conventional structure, it is a cause to decrease S/N thereof. Since secondary electrons colliding with the glass surfaces make no contribution to electron multiplication, they decrease the electron multiplication rate (gain characteristic) and also degrade the withstand voltage characteristic between electrodes.

On the other hand, in the case of the structure of the present embodiment shown in FIG. 12B (where the width of the vertical section of each column is made thinner near the center along the height direction), the glass substrate 40 of the lower frame 4 is provided with the recesses 42 on the opposite surface 40*a* thereof and the pedestals 330 of the respective stages of dynodes are installed on the intermediate portions 42*a* of the flat portions located between these recesses 42. The columns 51 with the secondary electron emitting surface of the curved shape being formed on the side face thereof are installed on each pedestal 330, integrally with the pedestal 330. These integrated pedestal 330 and columns 51 constitute each stage of dynode. On the other hand, in the glass substrate 20 of the upper frame 2, the conductive terminals 201C are in contact with the respective conductive films 202 evaporated on the opposite surface 20*a* of the glass substrate 20 and each conductive film 202 is electrically connected through the conductive material 205 to the top part of each column 51 (in practice, to the power feeding portion 53*a*-53*l* of each stage of dynode). The anode 34 is also composed of the pedestal and columns, and extracts the arriving secondary electrons as a signal through the conductive terminal 201D. The pedestal of the anode 34 is also installed on the intermediate portion 42*a* being the flat portion between recesses 42.

In the example of FIG. 12B, the secondary electron emitting surfaces (electrodes) are curved toward the centers thereof. Namely, in this shape, the spacing between adjacent dynodes is narrower on the end sides than in the region near the centers of the secondary electron emitting surfaces. This configuration drastically reduces the number of secondary electrons colliding with the surfaces of the glass substrate 40 (lower frame 4) and the glass substrate 20 (upper frame 2), i.e., with the surfaces of glass being the insulating material and, as a result thereof, the unwanted luminescence is effectively suppressed. Therefore, a light sensor employing the structure of the present embodiment is improved in S/N thereof and thus can perform highly accurate detection of light, as an effect of the suppression of luminescence. Since the secondary electron emitting surface 520 itself has the curved shape, the effective area of the secondary electron emitting surface 520 becomes larger without change in height of each column 51. For this reason, the electron multiplication rate can be drastically improved by synergistic effect of the increase in electron multiplication rate by the decrease of secondary electrons causing luminescence, and the expansion of the effective area.

Figure 13:
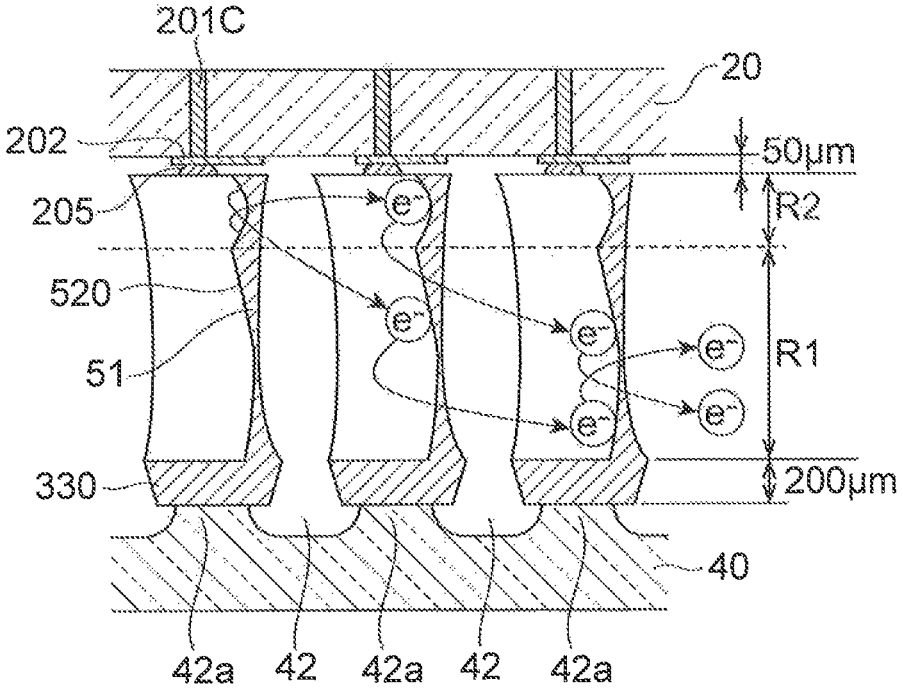
FIG. 13 is a drawing showing a sectional shape of dynodes according to a third modification example, along with a specific installation state, and drawing for explaining the effect of the dynodes according to the third modification example (corresponding to the section along the line II-II of the photomultiplier shown in FIG. 1).

Furthermore, a specific installation state of columns 51 that can be realized by another sectional shape of dynodes will be described below with reference to FIG. 13. FIG. 13 is a drawing showing the sectional shape of dynodes according to a third modification example, together with the specific installation state thereof, and drawing for explaining the effect of the dynodes according to the third modification example (which corresponds to the section along the line II-II of the photomultiplier in FIG. 1). It is also assumed that the upper frame 2 is comprised of a glass substrate 20 in the structure of FIG. 13.

As shown in FIG. 13, the glass substrate 40 of the lower frame 4 is provided with a plurality of recesses 42 on its opposite surface 40*a* and the pedestals 330 (with the thickness of 200 μm) of the respective stages of dynodes are installed on the intermediate portions 42*a* being flat portions located between these recesses 42. The columns 51 with the secondary electron emitting surface being formed on the side face thereof are installed on each pedestal 330, integrally with the pedestal 330. These integrated pedestal 330 and columns 51 constitute each stage of dynode. On the other hand, in the glass substrate 20 of the upper frame 2, the conductive terminals 201C are in contact with the respective conductive films 202 evaporated on the opposite surface 20*a* of the glass substrate 20 and each conductive film 202 is electrically connected through the conductive material 205 to the top of each column 51 (in practice, to the power feeding portion 53*a*-53*l* of each stage of dynode). In this structure, the glass substrate 20 and the tops of the columns 51 are spaced apart by 50 nm.

Particularly, the shape of the region where the secondary electron emitting surface 520 of each column 51 shown in FIG. 13 is formed is different in possession of two constricted structures (which may be three or more constricted structures), from the aforementioned structures shown in FIGS. 10, 11B, and 11C. Namely, in the example of FIG. 13, a curved surface with greater curvature is formed in the part nearer to the glass substrate 20 (region R2), whereby secondary electrons emitted therefrom are guided away from the glass substrate 20 (i.e., the secondary electrons generated in the region R2 are guided to region R1). This configuration decreases the number of secondary electrons colliding with the glass substrate 20 of the upper frame 2 and thus can effectively reduce the noise due to luminescence and withstand voltage failure due to electrification.

A wiring structure of the photomultiplier 1 will be described below with reference to FIGS. 14A-14B and 15.

Figure 14A:
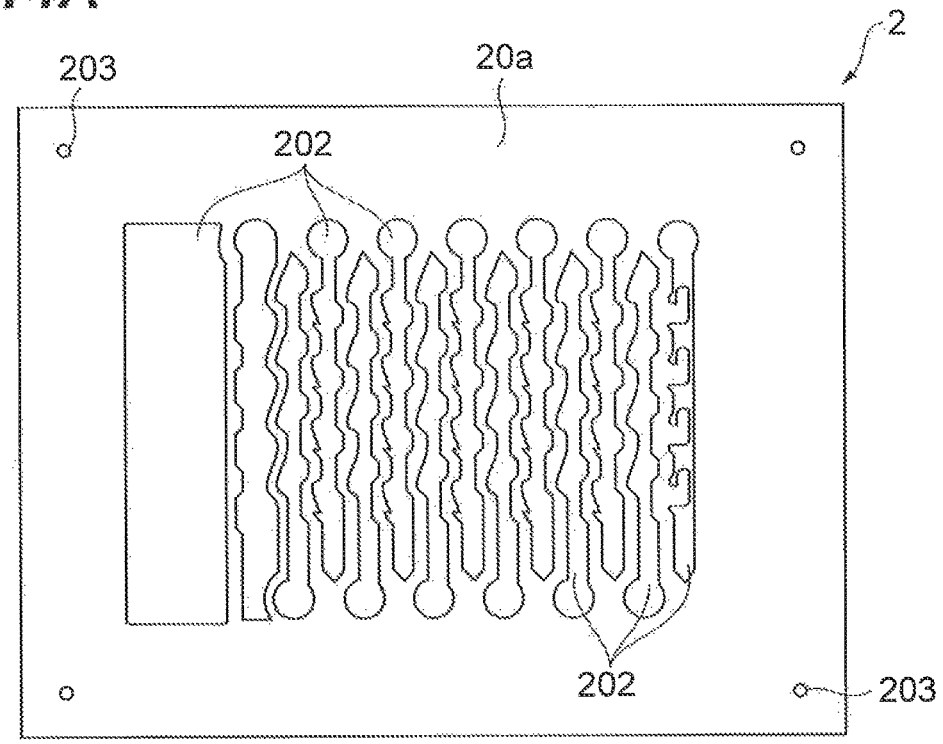
Figure 14B:
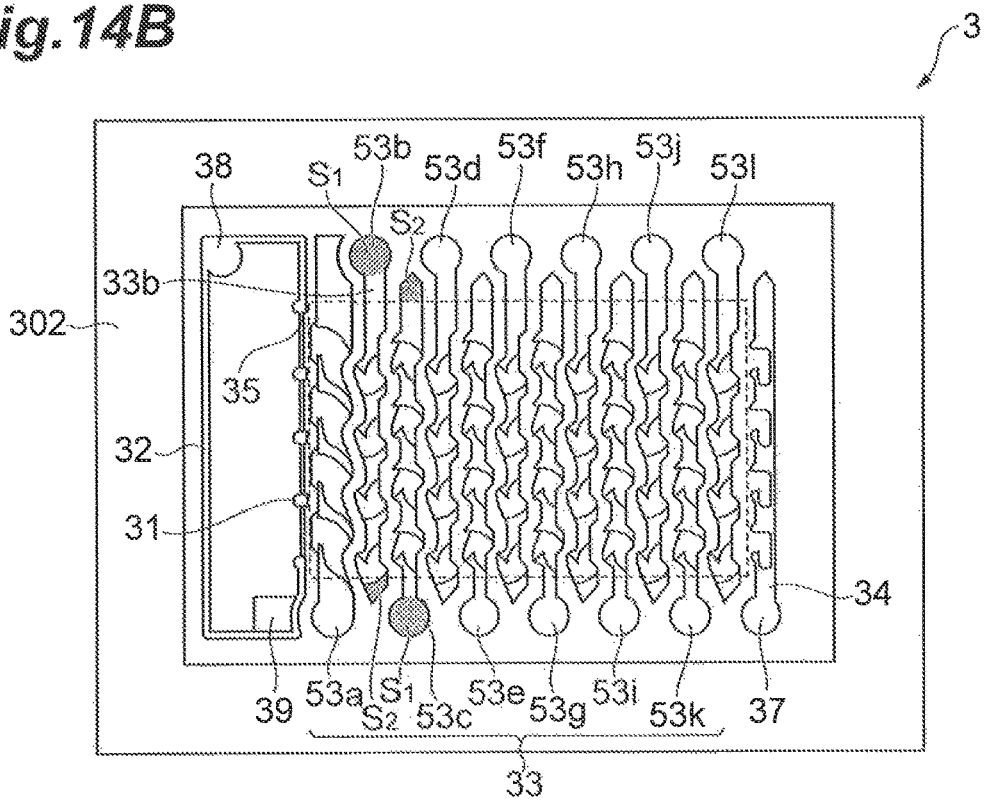

FIG. 14A is a bottom view from the back surface 20*a* side of the upper frame 2, and FIG. 14B a plan view of the sidewall frame 3. FIG. 15 is a perspective view showing a connection state between the upper frame 2 and the sidewall frame 3.

As shown in FIG. 14A, the opposite surface 20*a* of the upper frame 2 (which may be comprised of an insulating material such as glass) is provided with a plurality of conductive films (power feeding portions) 202 electrically connected respectively to the conductive terminals 201B, 201C, or 201D inside the upper frame 2, and conductive terminals 203 electrically connected to the respective conductive terminals 201A inside the upper frame 2. In the electron multiplier 33, as shown in FIG. 14B, power feeding portions 53*a*-53*l* for connection to the corresponding conductive films 202 are provided in an upright state, as described previously, and a power feeding portion 37 for connection to the conductive film 202 is provided in an upright state at an end of the anode 34. Furthermore, a power feeding portion 38 for connection to the conductive film 202 is provided in an upright state at a corner of the wall electrode 32. The focusing electrode 31 is formed integrally with the wall electrode 32 on the lower frame 4 side so as to be electrically connected to the wall electrode 32. Furthermore, a connection 39 of a rectangular flat plate shape is formed integrally with the wall electrode 32 on the opposite surface 40*a* side of the lower frame 4 and this connection 39 is bonded to a conductive film (not shown) formed in electrical contact with the photocathode 41 on the opposite surface 40*a*, thereby achieving electrical connection between the wall electrode 32 and the photocathode 41.

Figure 15:
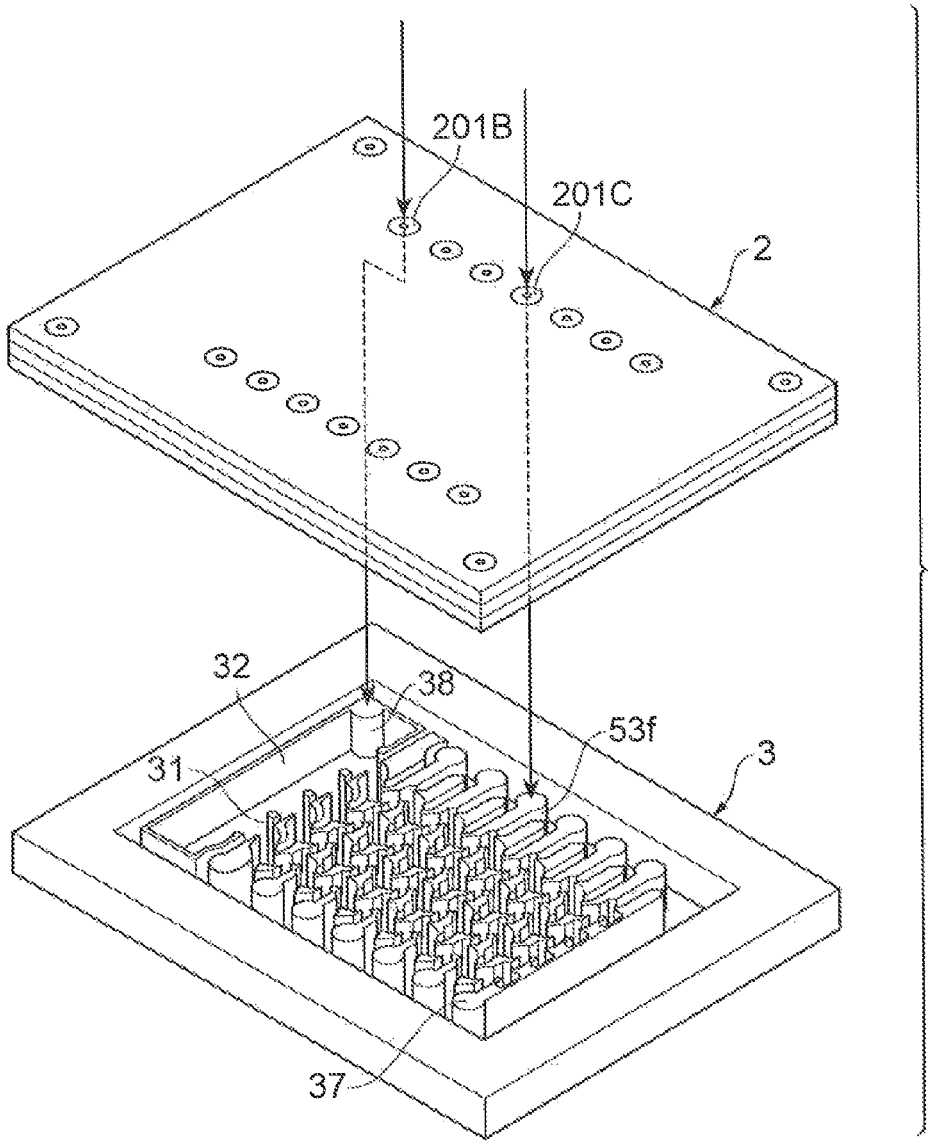
FIG. 15 is a perspective view showing a connection state of the upper frame and the sidewall frame shown in FIGS. 14A and 14B.

As shown in FIG. 15, when the upper frame 2 and the sidewall frame 3 of the above configuration are bonded to each other, the conductive terminals 203 come to be electrically connected to the sidewall part 302 of the sidewall frame 3. In addition, the power feeding portions 53*a*-53*l* of the electron multiplier 33, the power feeding portion 37 of the anode 34, and the power feeding portion 38 of the wall electrode 32 are independently connected each through a conductive member of gold (Au) or the like to the corresponding conductive films 202. In this connection configuration, the sidewall part 302, the electron multiplier 33, and the anode 34 are electrically connected to the conductive terminals 201A, 201C, or 201D, respectively, to enable power feeding from the outside (or extraction of signal to the outside), and the wall electrode 32, together with the focusing electrode 31 and the photocathode 41, is electrically connected to the conductive terminal 201B to realize power feeding from the outside (cf. FIG. 15).

As shown in FIG. 14B, the shape of the pedestal 52*b* and power feeding portion 53*b* of the dynode 33*b* is so defined that the sectional area $S_1$ along the opposite surface 40*a* of one end continuous to the power feeding portion 53*b* out of the two ends of the pedestal 52*b* of the dynode 33*b* becomes larger than the sectional area $S_2$ along the opposite surface 40*a* of the other end out of the two ends. This size relation between the one end with the power feeding portion 53*b* and the other end in the dynode 33*b* is continuously satisfied throughout the entire ends of the dynode 33*b*, i.e., up to the surface on the upper frame 2 side. For this reason, the one end with the power feeding portion 53*b* is larger than the other end in terms of the area, when viewed from the direction normal to the opposite surface 40*a*, and in terms of the volume thereof as well. In this manner, the one end with the power feeding portion 53*b* is superior in physical strength and, in addition thereto, the surface on the upper frame 2 side is large enough to increase the contact area with the conductive member of gold (Au) or the like, which is also effective to secure electrical connection. The other dynodes 33*a*, 33*c*-33*l* forming the electron multiplier 33 are also defined in the sectional shape satisfying the same relation. The multistage dynodes 33*a*-33*l* are arranged so that their one ends on the side of the power feeding portions 53*a*-53*l* and the other ends on the opposite side are aligned in a staggered manner along the electron multiplication direction on the opposite surface 40*a*. In other words, the multistage dynodes 33*a*-33*l* are disposed on the opposite surface 40*a* so that the orientations of the pedestals based on the arrangement direction of the power feeding portions 53*a*-53*l* thereof (orientations of the pedestals defined in the direction extending from the one end with the power feeding portion to the other end) are alternately opposite to each other.

In the photomultiplier 1 described above, incident light is incident into the photocathode 41 to be converted to photoelectrons, the photoelectrons are incident into the electron multiplication channels C formed by the multistage dynodes 33*a*-33*l* on the inner surface 40*a* of the lower frame 4 in the housing 5 to be multiplied, and the multiplied electrons are extracted as an electric signal from the anode 34.

Explaining the example of the dynodes 33*a*-33*d*, each dynode 33*a*-33*d* is provided with the pedestal 52*a*-52*d* at the end on the lower frame 4 side, the power feeding portion 53*a*-53*d* extending from the one end toward the upper frame 2 opposed to the lower frame 4 is electrically connected to the pedestal 52*a*-52*d*, and the power feeding portion 53*a*-53*d* is connected to the conductive film 202 provided on the inner surface 20*a* of the upper frame 2, thereby implementing power feeding to each dynode 33*a*-33*d*. Furthermore, the recesses 42 as shown in FIG. 2 are formed in the region enclosed in a dashed line, on the opposite surface 40*a* of the lower frame 4, and the pedestal 52*a*-52*d* is installed on the intermediate portion 42*a* being the flat portion located between recesses 42. The sectional area $S_1$ along the opposite surface 40*a* of the one end on the power feeding portion 53*a*-53*d* side is larger than the sectional area $S_2$ of the other end. As the strength is increased at the end of the pedestal 52*a*-52*d* on the side in contact with the conductive film 202 of the upper frame 2, the physical strength of the electron multiplier 33 is ensured against pressure due to contact for power feeding. As a result, it is feasible to suppress reduction in withstand voltage between electrodes, without deformation, breakage, or the like.

In the present embodiment the recesses 42 arranged via the intermediate portions 42*a* of the flat portions are formed in the region enclosed in the dashed line on the opposite surface 40*a* of the lower frame 4, but it is also possible to adopt a configuration wherein a common recess is formed with the entire dashed region as a bottom surface. In this case, since the central portions of the pedestals 52*a*-52*d* are arranged on the common recess, the central portions of the pedestals 52*a*-52*d* can be separated from the insulating surface of the lower frame 4, without reduction in strength of the electron multiplier 33. Furthermore, since the common recess is formed across the central portions of the pedestals 52*a*-52*d*, the frame is prevented from electrification due to entrance of secondary electrons passing between the multistage dynodes 33*a*-33*d* into the insulating surface and it is feasible to further suppress the reduction in withstand voltage.

Figure 16A:
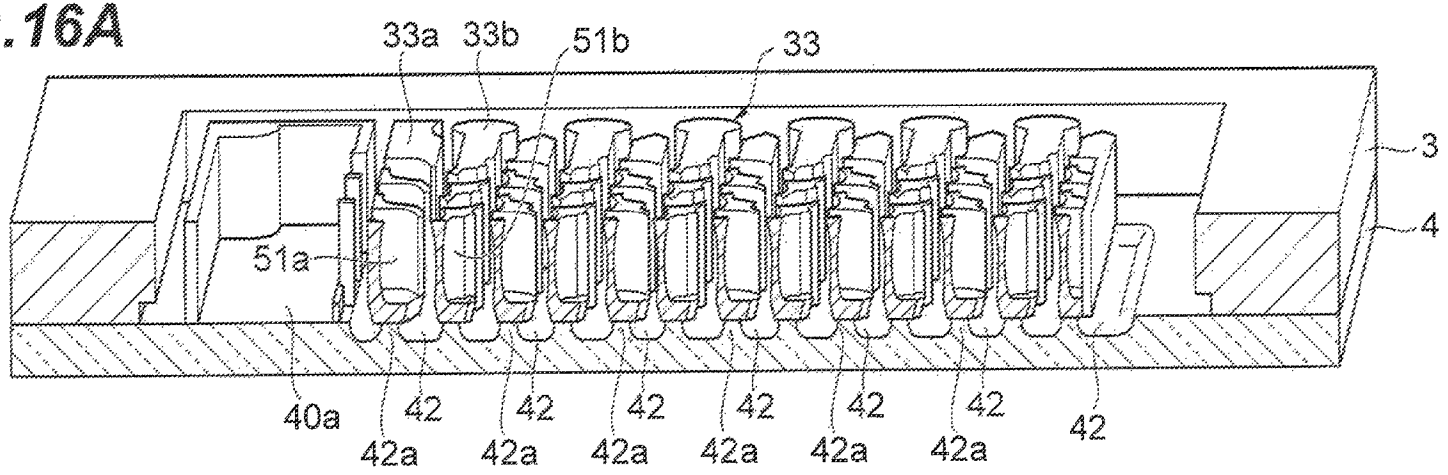
Figure 16B:
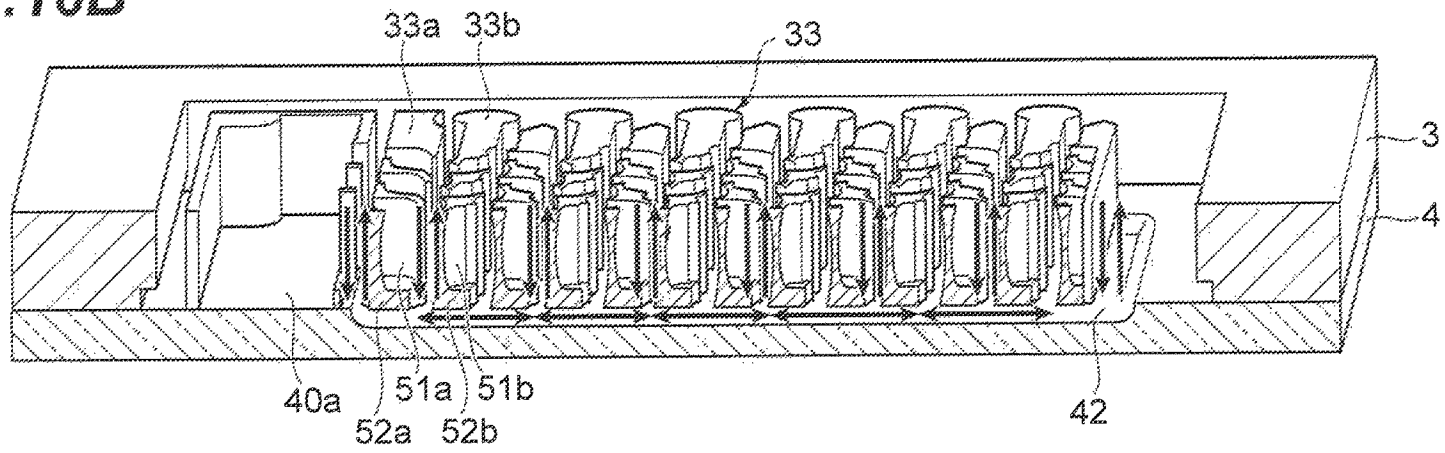

Furthermore, the common recess also has the below-described effects because each dynode 33*a*-33*l* is separated from the opposite surface 40*a* of the lower frame 4. FIGS. 16A and 16B are partly broken perspective views of the sidewall frame and the lower frame shown in FIG. 1 (corresponding to the section along the line II-II of the photomultiplier in FIG. 1), wherein FIG. 16A is a drawing in which the lower frame of the first structure is applied and FIG. 16B is a drawing in which the lower frame of the second structure example is applied. The recesses 42 with the intermediate portions 42*a* in between may be formed, as shown in FIG. 16A, on the opposite surface 40*a* in the glass substrate 40 of the lower frame 4, or one common recess 42 may be formed as shown in FIG. 16B. It is, however, noted that the description hereinbelow follows the configuration of FIG. 16B.

The dynodes 33*a*, 33*b* will be illustrated as an example; during activation of the secondary electron emitting surfaces on the surfaces of the curved shape or tapered shape of the columns 51*a*, 51*b* thereof, flow of vapor of alkali metal (K, Cs, or the like) becomes improved between the stages of dynodes 33*a*, 33*b* and in the region below the dynodes 33*a*, 33*b* (in directions indicated by arrows in FIG. 16B), which facilitates formation of uniform secondary electron surfaces. Since the bond area can be made smaller between the electron multiplier 33 and the lower frame 4, failure in bonding is prevented from occurring due to foreign matter intruding into between the electron multiplier 33 and the lower frame 4, so as to enhance reliability. Furthermore, since the internal volume of the housing 5 is increased by the structure with the common recess 42 to space the dynodes 33*a*-33*l* apart, degradation of vacuum degree can be suppressed even with discharge of gas from the internal constituent members. For example, in comparison to the photomultiplier without the recess 42 where the thickness of the dynodes 33*a*-33*l* is 1 mm, the photomultiplier in which the thickness of the dynodes 33*a*-33*l* is equal, the depth of the common recess 42 is 0.2 mm, and a rate of the processed area of the common recess 42 to the opposite surface 40*a* is 50%, can have the internal volume increased by about 10%. Furthermore, even if there is foreign matter in the housing 5, the foreign matter is less likely to intrude into between the dynodes 33*a*-33*l* because the foreign matter is likely to drop onto the bottom of the common recess 42 separated from the dynodes 33*a*-33*l*; therefore, the withstand voltage failure due to foreign matter is reduced. Since the contact area becomes smaller between the housing 5 and the dynodes 33*a*-33*l*, a temperature change at the housing 5 is less likely to affect the electron multiplier 33, which can reduce damage to the secondary electron emitting surfaces with increase in ambient temperature. Particularly, this effect is important in the structure in which the electrodes of the electron multiplier and others are arranged directly on the internal surface of the housing 5.

Furthermore, the pedestals corresponding to the multistage dynodes 33*a*-33*l* are arranged with the one ends on the side of power feeding portions 53*a*-53*l* and the other ends on the opposite side thereto being in the staggered relation, along the opposite surface 40*a* of the lower frame 4. Namely, for example, in the case of the dynodes 33*b* and 33*c* adjacent to each other, they are arranged in such a manner that the end of the dynode 33*c* facing the one end on the power feeding portion 53*b* side of the dynode 33*b* is the other end and that the end of the dynode 33*c* facing the other end of the dynode 33*b* is the one end on the power feeding portion 53*c* side. The dynodes are arranged so as to satisfy this relation throughout the multistage dynodes 33*a*-33*l*. Namely, since the other end of an adjacent dynode is adjacent to the one end on the power feeding portion 53*a*-53*l* side, the sectional area along the lower frame 4 of the end on the power feeding portion 53*a*-53*l* side of each pedestal can be increased, which can further enhance the physical strength of the electron multiplier 33. Furthermore, the sectional shape along the lower frame 4 of the other end (the shape viewed from the direction normal to the opposite surface 40*a* of the lower frame 4) has the pointed shape extending in a direction approximately perpendicular to the electron multiplication direction (i.e., in the direction from the one end to the other end in each dynode). Since the other end has the pointed shape as described above, the bond area to the lower frame 4 is also increased while maintaining the spacing to the power feeding portions 53*a*-53*l*; therefore, it is feasible to suppress reduction in withstand voltage between electrodes.

Figure 17:
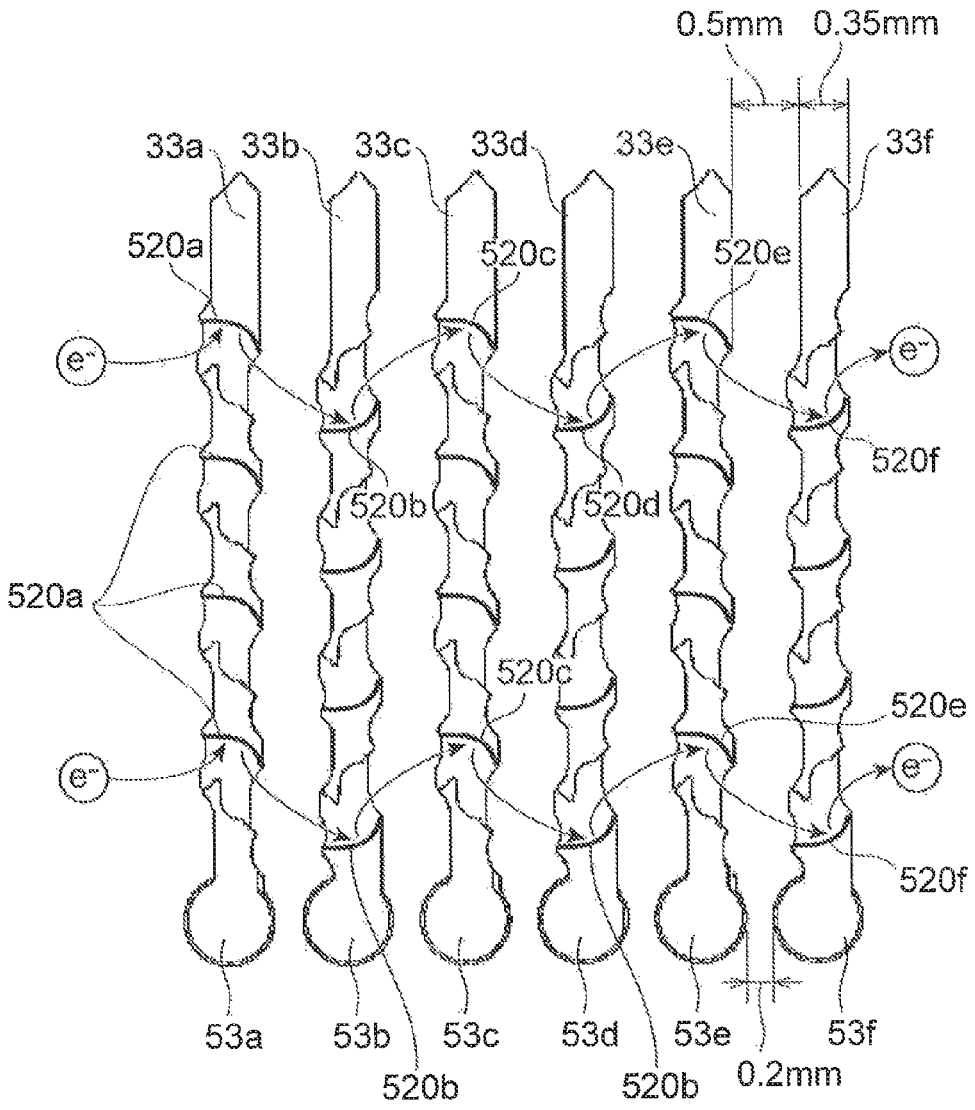
FIG. 17 is a plan view of the electron multiplier according to a first comparative example.
Figure 18:
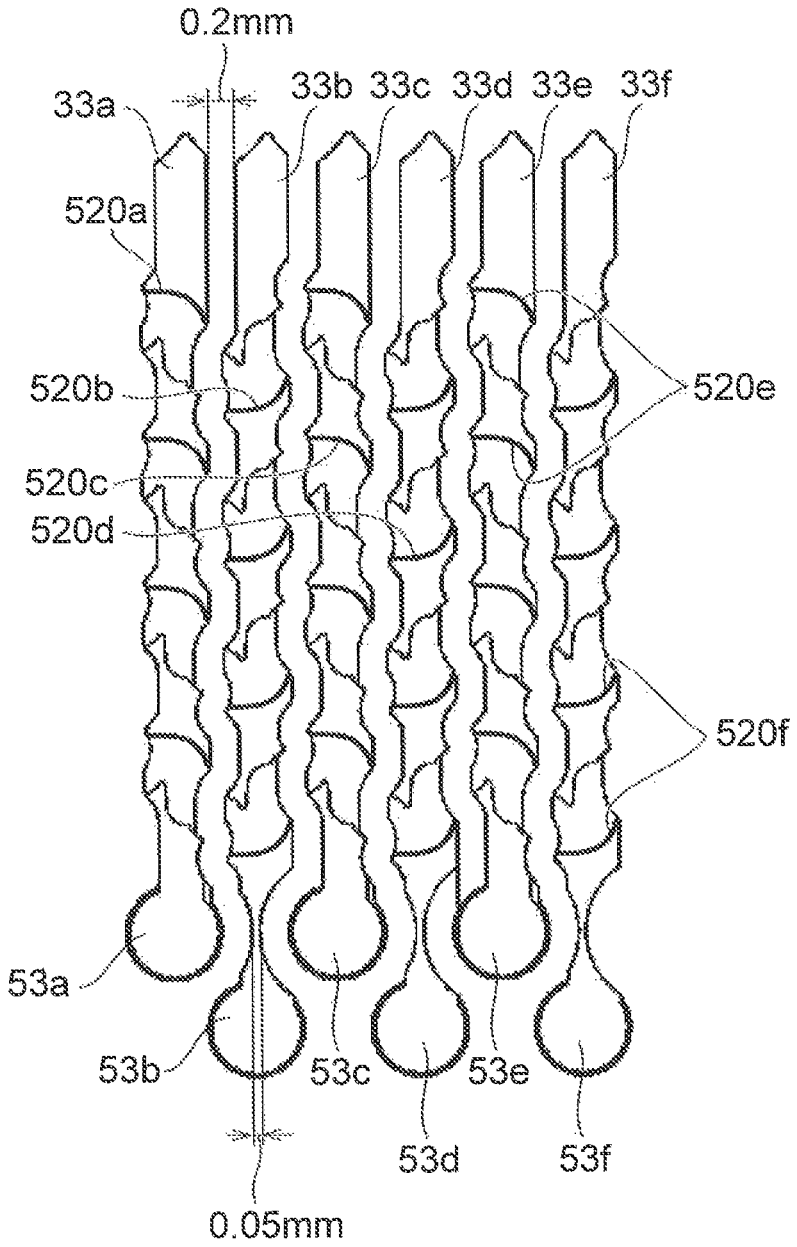
FIG. 18 is a plan view of the electron multiplier according to a second comparative example.

In contrast to it, in the case of a configuration wherein the ends on the power feeding portion 53*a*-53*l* side are arranged next to each other along the opposite surface 40*a* as shown in FIG. 17, the spacing between dynodes needs to be set at a large value (e.g., 0.5 mm in the case where the thickness of dynodes is 0.35 mm) in view of the withstand voltage between the power feeding portions 53*a*-53*l*. As a result, a larger area is needed for arrangement of the same number of dynodes, so as to increase an area per chip in processing silicon substrates by batch processing, resulting in increase in chip cost. Furthermore, the increase in dynode spacing leads to reduction in electron multiplication rate, so as to degrade the performance of the photomultiplier. On the other hand, in order to decrease the dynode spacing, it can be contemplated that the power feeding portions 53*a*-53*f* of the dynodes 33*a*-33*f* are arranged next to each other in an alternately shifted manner so as to meander along the opposite surface 40*a*, as shown in FIG. 18. This configuration decreases the dynode spacing (e.g., to 0.2 mm) and increases the electron multiplication rate to some extent, but it is necessary to make considerably thin (e.g., 0.05 mm) portions between the ends on the power feeding portion 53*b*, 53*d* side and the central regions of the dynodes 33*b*, 33*d*, in order to maintain the withstand voltage between stages of the dynodes 33*b*, 33*d* with the power feeding portions 53*b*, 53*d* projecting out. It results in reduction in strength of the dynodes 33*b*, 33*d*, which can cause cracking or breakage so as to result in failure in power feeding to the secondary electron surfaces. As another possibility, it is also conceivable that the electrical resistance increases even without occurrence of cracking, so as to hinder potential supply from the power feeding portions 53*b*, 53*d* to the central regions of the dynodes with the secondary electron surfaces. It was found from this consideration that the arrangement of dynodes 33*a*-33*l* in the present embodiment was advantageous in terms of the suppression of reduction in withstand voltage and in terms of the electron multiplication rate because of the feasibility of arrangement with the narrow dynode spacing as well.

FIG. 17 is a plan view of the electron multiplier according to the first comparative example, in which reference signs 520*a*-520*f* denote the secondary electron emitting surfaces provided in the respective stages of dynodes 33*a*-33*f*. FIG. 18 is a plan view of the electron multiplier according to the second comparative example.

Figure 19:
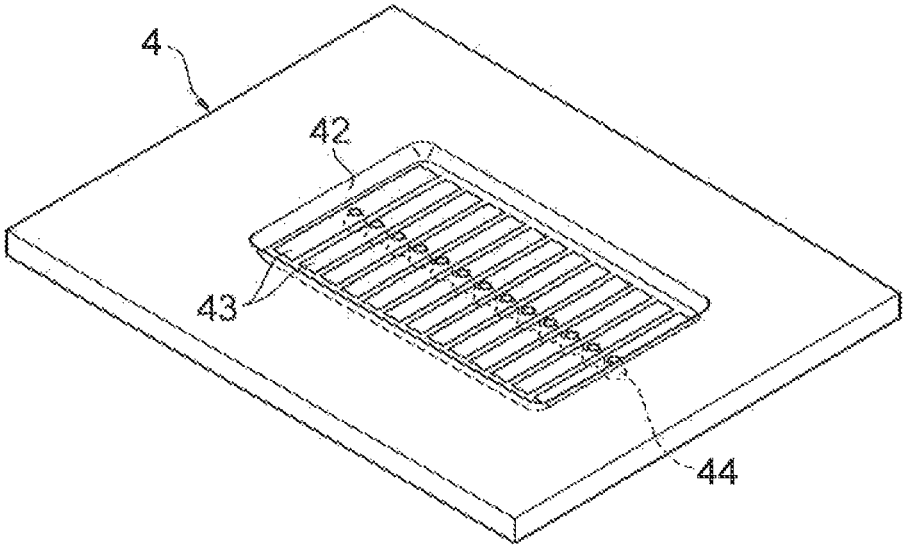
FIG. 19 is a perspective view of the lower frame in the photomultiplier according to a first modification example of the present invention.
Figure 20:
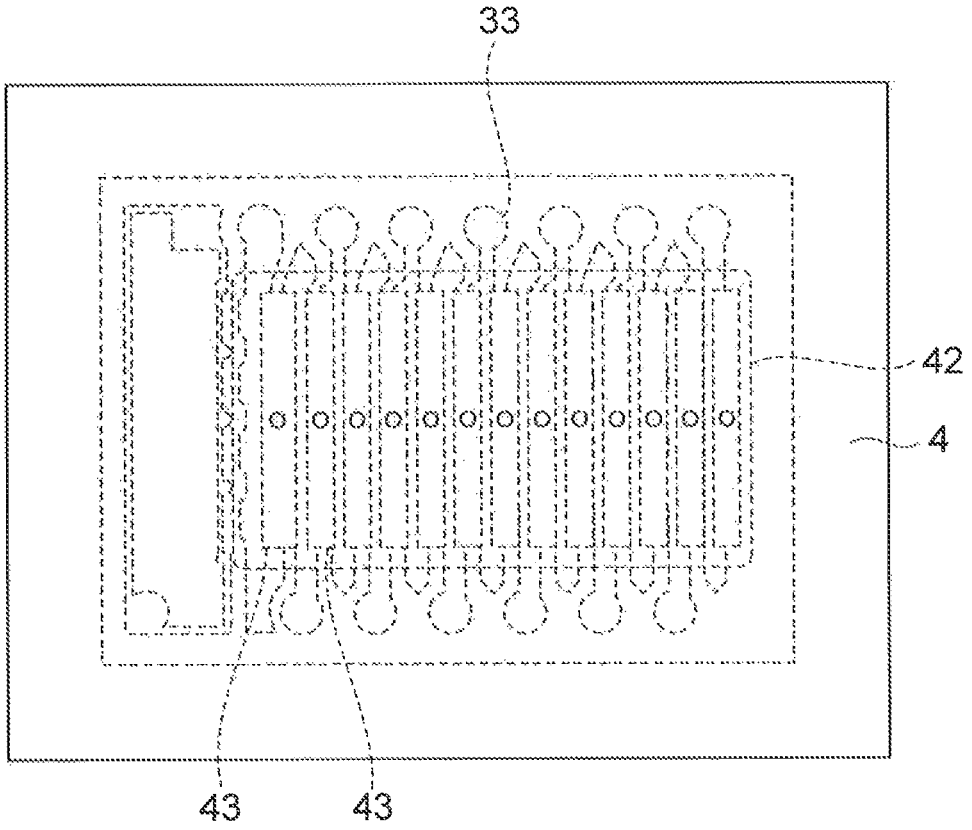
FIG. 20 is a bottom view from the back side of the lower frame shown in FIG. 19.
Figure 21A:
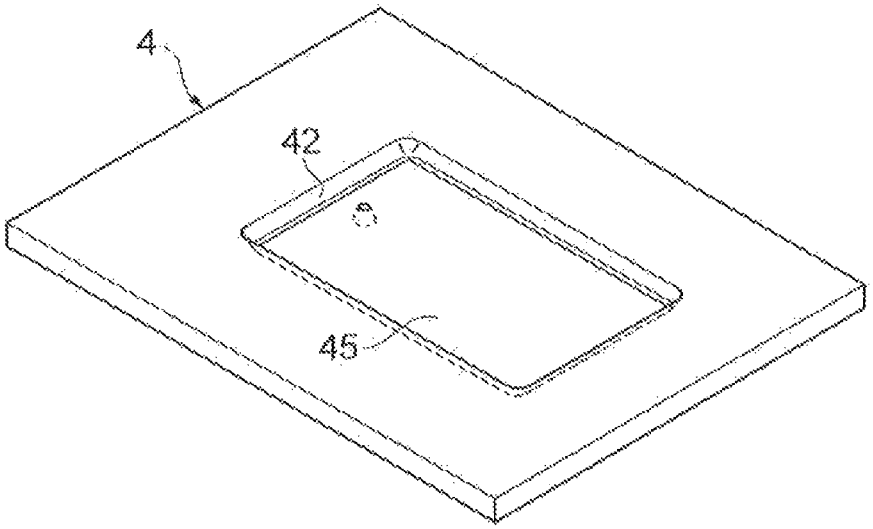
FIG. 21A is a drawing showing a third structure of the lower frame applicable to the photomultiplier of the second modification example and FIG. 21B is a drawing showing a fourth structure of the lower frame applicable to the photomultiplier of the second modification example.
Figure 21B:
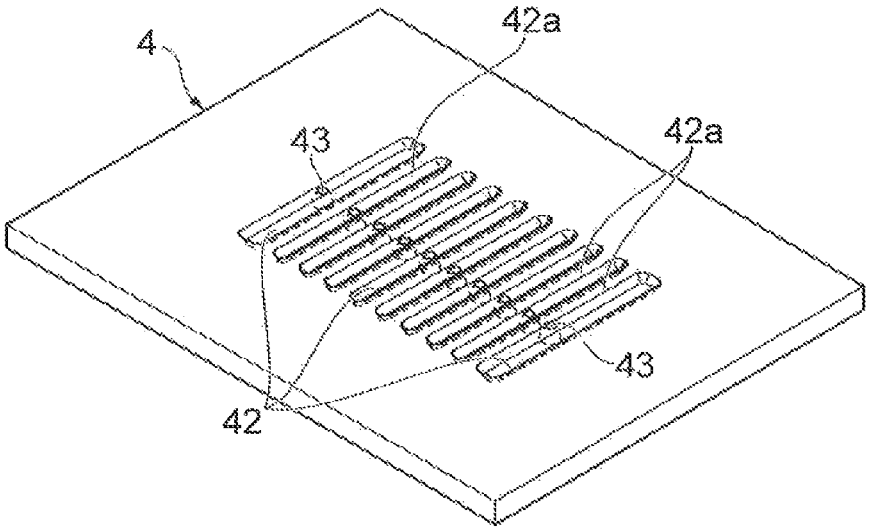

It should be noted that the present invention is not limited solely to the above-described embodiments. For example, as shown in FIGS. 19 and 20, a plurality of beltlike conductive films 43 may be formed so as to prevent the insulating surface of the lower frame 4 from being exposed, corresponding to the positions between the stages of the dynodes 33*a*-33*l* in the electron multiplier 33 and between the electron multiplier 33 (dynode 33*l*) and the anode 34, on the bottom surface of the recess 42 of the lower frame 4. Power is fed to the conductive films 43 by conductive terminals 44 provided through the lower frame 4. This configuration can surely prevent electrification due to incidence of electrons passing through the electron multiplier 33, into the lower frame 4. Furthermore, electrification of the lower frame 4 can also be prevented by providing a conductive film 45 on the bottom surface of the recess 42 across the entire region of the electron multiplier 33, as shown in FIG. 21A. However, this configuration increases the potential difference between the conductive film 45 and each dynode in the electron multiplier 33, and therefore the configuration of FIG. 19 is more preferred. In this case, as shown in FIG. 21B, the lower frame 4 may be configured so that conductive films 43 are formed on the bottom surfaces of the recesses 42 arranged with intermediate portions 42*a* in between.

FIG. 19 is a perspective view of the lower frame in the photomultiplier according to the first modification example of the present invention. FIG. 20 is a bottom view from the back side of the lower frame in FIG. 19. Furthermore, FIGS. 21A and 21B are perspective views of the lower frame in the photomultiplier according to the second modification example of the present invention, wherein FIG. 21A is a drawing showing the third structure of the lower frame applicable to the photomultiplier according to the second modification example and FIG. 21B a drawing showing the fourth structure of the lower frame applicable to the photomultiplier according to the second modification example.

The embodiments of the present invention employed the photocathode 41 of the transmissive photoelectric surface, but the photocathode 41 may be a reflective photoelectric surface or the photocathode 41 may be arranged on the upper frame 2 side. In the case where the photocathode 41 is arranged on the upper frame 2 side, the upper frame 2 can be one in which power feeding terminals are buried in an insulating substrate with optical transparency such as a glass substrate and the lower frame 4 can be one of various insulating substrates except for the glass substrate. The anode 34 may be located between dynode 33*k* and dynode 33*l*.

In the photomultiplier of the embodiment, as described above, the electron multiplier is composed of the multistage dynodes arranged in series along the first direction parallel to the opposite surface of the lower frame. The section of each column in the dynodes, which is defined by a plane including the first direction and being perpendicular to the opposite surface of the lower frame, has the shape such that the width thereof along the first direction becomes minimum between the lower-frame-side end and the upper-frame-side end of the column. When the shape of the secondary electron emitting surfaces in the columns is processed to the depressed shape along the height direction of the columns as described above, the trajectories of electrons traveling from the secondary electron emitting surfaces toward the lower frame or toward the upper frame are effectively corrected.

From the above description of the present invention, it is obvious that the present invention can be modified in many ways. Such modifications are not recognized as departing from the spirit and scope of the present invention and all improvements obvious to those skilled in the art are intended for inclusion in the scope of claims that follow.

What is claimed is:

1. An electron multiplier supported by an installation surface that is defined by a first direction and a second direction perpendicular to the first direction, comprising multistage dynodes arranged in series on the installation surface, along the first direction on the installation surface, and configured to implement cascade multiplication of electrons traveling along a direction parallel to the first direction, the multistage dynodes constituted by:

a first dynode directly fixed on the installation surface, the first dynode having a column that extends a third direction perpendicular to both the first and second directions; and a second dynode directly fixed on the installation surface in a state that the second dynode is spaced from the first dynode along the first direction, the second dynode having a column that extends along the third direction and is spaced from the column in the first dynode;

wherein, in each of the first and second dynodes, the column has a cross-section in a horizontal plane parallel to the installation surface that varies in at least one of size or shape depending upon the height of the column in the third direction.

2. The electron multiplier according to claim 1, wherein in each of the first and second dynodes, a region where a single secondary electron emitting surface is formed in the peripheral surface of the column has a cross-section defined by a plane perpendicular to the second direction and being in parallel to both of the first and third directions, said cross-section having a two-dimensional shape defined by line segments including one or more depressions entering into said column.

3. The electron multiplier according to claim 1, wherein in each of the first and second dynodes, the column has a cross-section defined by a plane perpendicular to the second direction and being parallel to both of the first and third directions, said cross-section having a two-dimensional shape such that a width of said cross-section defined by a length along the first direction changes in a continuous or step-wise fashion along the third direction.

4. The electron multiplier according to claim 1, wherein in each of the first and second dynodes, a surface shape of a region where a single secondary electron emitting surface is formed in the peripheral surface of the column is composed of one or more curved surfaces, one or more planes, or a combination thereof.

5. A photomultiplier comprising:

an envelope an interior of which is maintained in a reduced pressure state, and at least a part of which is comprised of a substrate of an insulating material having an installation surface;

a photocathode which is housed in an interior space of the envelope and which emits photoelectrons into the interior of the envelope according to light incident through the envelope;

the electron multiplier as defined in claim 1, which is arranged on the installation surface in a state in which the electron multiplier is housed in the interior space of the envelope; and an anode which is arranged on the installation surface in a state in which the anode is housed in the interior space of the envelope, and which is provided for extracting arriving electrons out of electrons resulting from cascade multiplication by the electron multiplier, as a signal.

6. The photomultiplier according to claim 5, wherein as a relation of regions facing each other between the first and second dynodes, each of a region where a single secondary electron emitting surface is formed in the peripheral surface of the column in one dynode and a region where a single secondary electron emitting surface is formed in the peripheral surface of the column in the other dynode, has a cross-section defined by a plane perpendicular to the second direction and being parallel to both of the first and third directions, said cross-section having a surface shape depressed in a direction away from the other dynode.

7. The photomultiplier according to claim 5, wherein the envelope comprises: a lower frame at least a part of which having the installation surface is comprised of an insulating material; an upper frame which is arranged opposite to the lower frame and at least part of which having a surface facing the installation surface of the lower frame is comprised of an insulating material; and a sidewall frame which is disposed between the upper frame and the lower frame and which has a shape to surround the electron multiplier and the anode, and wherein the electron multiplier and the anode are arranged on the installation surface in a state in which the electron multiplier and the anode are spaced apart from each other by a predetermined distance.

8. The photomultiplier according to claim 5, further comprising a plurality of recesses arranged in a state in which the recesses are spaced apart by a predetermined distance on the installation surface, each recess extending along the second direction on the installation surface, wherein each of the first and second dynodes is arranged on the installation surface so as to be located between the recesses.

9. An electron multiplier supported by an installation surface that is defined by a first direction and a second direction perpendicular to the first direction, comprising multistage dynodes arranged in series on the installation surface, along the first direction on the installation surface, and configured to implement cascade multiplication of electrons traveling along a direction parallel to the first direction, the multistage dynodes constituted by:

a first dynode directly fixed on the installation surface, the first dynode having a column that extends a third direction perpendicular to both the first and second directions; and a second dynode directly fixed on the installation surface in a state that the second dynode is spaced from the first dynode along the first direction, the second dynode having a column that extends along the third direction and is spaced from the column in the first dynode;

wherein, in each of the first and second dynodes, at least one surface of the column is covered by a single secondary electron emitting surface, and the column has a cross-section that is indented on each side, with at least one side of the cross-section having a protrusion or depression, when viewed in the second direction, and wherein the cross-section at least widens or narrows along the third direction.

10. The electron multiplier according to claim 9, wherein in each of the first and second dynodes, the column has a cross-section defined, by a plane perpendicular to the second direction and being in parallel to both of the first and third directions, said cross-section having a two-dimensional shape such that a width of said cross-section defined by a length along the first direction changes in a continuous or step-wise fashion along the third direction.

11. The electron multiplier according to claim 9, wherein in each of the first and second dynodes, a surface shape of the region where the single secondary electron emitting surface is formed in the peripheral surface of the column is composed of one or more curved surfaces, one or more planes, or a combination thereof.

12. A photomultiplier comprising:

an envelope an interior of which is maintained in a reduced pressure state, and at least a part of which is comprised of a substrate of an insulating material having an installation surface;

a photocathode which is housed in an interior space of the envelope and which emits photoelectrons into the interior of the envelope according to light incident through the envelope;

the electron multiplier as defined in claim 9, which is arranged on the installation surface in a state in which the electron multiplier is housed in the interior space of the envelope; and an anode which is arranged on the installation surface in a state in which the anode is housed in the interior space of the envelope, and which is provided for extracting arriving electrons out of electrons resulting from cascade multiplication by the electron multiplier, as a signal.

13. The photomultiplier according to claim 12, wherein as a relation of regions facing each other between the first and second dynodes, each of a region Where a single secondary electron emitting surface is formed in the peripheral surface of the column in one dynode and a region where a single secondary electron emitting surface is formed in the peripheral surface of the column in the other dynode, has a cross-section defined by a plane perpendicular to the second direction and being in parallel to both of the first and third directions, said cross-section having a surface shape depressed in a direction away from the other dynode.

14. The photomultiplier according to claim 12, wherein the envelope comprises: a lower frame at least a part of which having the installation surface is comprised of an insulating material; an upper frame which is arranged opposite to the lower frame and at least a part of which having a surface facing the installation surface of the lower frame is comprised of an insulating material; and a sidewall frame which is disposed between the upper frame and the lower frame and which has a shape to surround the electron multiplier and the anode, and wherein the electron multiplier and the anode are arranged on the installation surface in a state in which the electron multiplier and the anode are spaced apart from each other by a predetermined distance.

15. The photomultiplier according to claim 12, further comprising a plurality of recesses arranged in a state in which the recesses are spaced apart by a predetermined distance on the installation surface, each recess extending along the second direction on the installation surface, wherein each of the first and second dynodes is arranged on the installation surface so as to be located between the recesses.

16. An electron multiplier supported by an installation surface that is defined by a first direction and a second direction perpendicular to the first direction, comprising multistage dynodes arranged in series on the installation surface, along the first direction on the installation surface, and configured to implement cascade multiplication of electrons traveling along a direction parallel to the first direction, the multistage dynodes constituted by:

a first dynode directly fixed on the installation surface, the first dynode having a column that extends a third direction perpendicular to both the first and second directions; and a second dynode directly fixed on the installation surface in a state that the second dynode is spaced from the first stage of dynode along the first direction, the second dynode having a column that extends along the third direction and is spaced from the column in the first dynode;

wherein in each of the first and second dynodes, the column has a cross-section that is indented on each side, with at least one side of the cross-section having a protrusion or depression, when viewed in the second direction, wherein the cross-section has a two-dimensional shape and an area, wherein the cross-section at least one of widens or narrows in a continuous stepwise fashion along the third direction.

17. The electron multiplier according to claim 16, wherein in each of the first and second dynodes, a surface shape of a region where a single secondary electron emitting surface is formed in the peripheral surface of the column is composed of one or more curved surfaces, one or more planes, or a combination thereof.

18. A photomultiplier comprising:

an envelope an interior of which is maintained in a reduced pressure state, and at least a part of which is comprised of a substrate of an insulating material having an installation surface;

a photocathode which is housed in an interior space of the envelope and which emits photoelectrons into the interior of the envelope according to light incident through the envelope;

the electron multiplier as defined in claim 16, which is arranged on the installation surface in a state in which the electron multiplier is housed in the interior space of the envelope; and an anode which is arranged on the installation surface in a state in which the anode is housed in the interior space of the envelope, and which is provided for extracting arriving electrons out of electrons resulting from cascade multiplication by the electron multiplier, as a signal.

19. The photomultiplier according to claim 18, wherein as a relation of regions facing each other between the first and second dynodes, each of a region where a single secondary electron emitting surface is formed in the peripheral surface of the column in one dynode and a region where a single secondary electron emitting surface is formed in the peripheral surface of the column in the other dynode, has a cross-section defined by a plane perpendicular to the second direction and being in parallel with both of the first and third directions, said cross-section having a surface shape depressed in a direction away from the other dynode.

20. The photomultiplier according to claim 18, wherein the envelope comprises: a lower frame at least a part of which having the installation surface is comprised of an insulating material; an upper frame which is arranged opposite to the lower frame and at least a part of which having a surface facing the installation surface of the lower frame is comprised of an insulating material; and a sidewall frame which is disposed between the upper frame and the lower frame and which has a shape to surround the electron multiplier and the anode, and wherein the electron multiplier and the anode are arranged on the installation surface in a state in which the electron multiplier and the anode are spaced apart from each other by a predetermined distance.

21. The photomultiplier according to claim 18, further comprising a plurality of recesses arranged in a state in which the recesses are spaced apart by a predetermined distance on the installation surface, each recess extending along the second direction on the installation surface, wherein each of the first and second dynodes is arranged on the installation surface so as to be located between the recesses.

* * * * *